US010870272B2

(12) United States Patent
Nozawa

(10) Patent No.: US 10,870,272 B2
(45) Date of Patent: Dec. 22, 2020

(54) LIQUID DISCHARGING APPARATUS AND DRIVING CIRCUIT BOARD

(71) Applicant: Seiko Epson Corporation, Tokyo (JP)

(72) Inventor: Dai Nozawa, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/581,904

(22) Filed: Sep. 25, 2019

(65) Prior Publication Data

US 2020/0101723 A1 Apr. 2, 2020

(30) Foreign Application Priority Data

Sep. 27, 2018 (JP) ..... 2018-181772

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04541; B41J 2/04581; B41J 2/04595; B41J 2/04588; B41J 2/14233; B41J 2002/14491
See application file for complete search history.

(56) References Cited

U.S. PATENT DOCUMENTS

2016/0009080 A1* 1/2016 Akune ..... B41J 2/04595 347/10
2017/0266960 A1* 9/2017 Nozawa ..... B41J 2/04581
2018/0178510 A1 6/2018 Nakajima
2018/0183352 A1* 6/2018 Kitazawa ..... B41J 2/04541

FOREIGN PATENT DOCUMENTS

JP 2018-099865 A 6/2018

* cited by examiner

*Primary Examiner* — Sharon Polk
(74) *Attorney, Agent, or Firm* — Harness, Dickey & Pierce, P.L.C.

(57) ABSTRACT

A liquid discharging apparatus has: a first driving signal creation circuit that has a first transistor and a first integrated circuit; a second driving signal creation circuit that has a second transistor and a second integrated circuit; a third driving signal creation circuit that has a third transistor and a third integrated circuit; and a circuit board having a first side, a second side opposite to the first side, a third side, and a fourth side opposite to the third side. The first integrated circuit and first transistor are positioned on the circuit board side by side in a direction away from the first side and toward the second side. The third integrated circuit and third transistor are positioned on the circuit board side by side in a direction away from the third side and toward the fourth side.

10 Claims, 17 Drawing Sheets

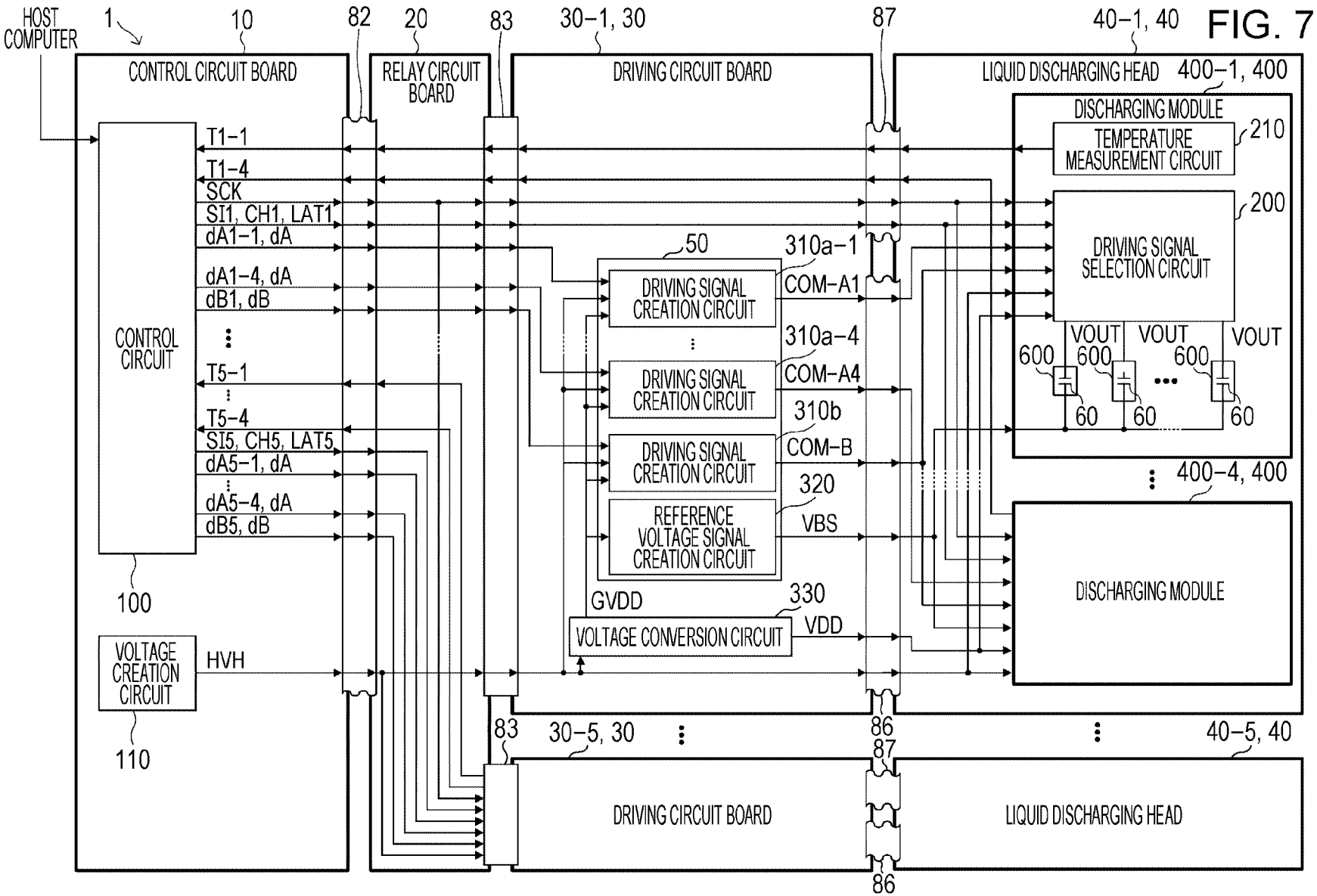
FIG. 7
HOST COMPUTER
1
CONTROL CIRCUIT BOARD
10
CONTROL CIRCUIT
100
VOLTAGE CREATION CIRCUIT
110
T1-1
T1-4
SCK
SI1, CH1, LAT1
dA1-1, dA
dA1-4, dA
dB1, dB
T5-1
T5-4
SI5, CH5, LAT5
dA5-1, dA
dA5-4, dA
dB5, dB
HVH
82
RELAY CIRCUIT BOARD
20
83
DRIVING CIRCUIT BOARD
30-1, 30
30-5, 30
87
86
LIQUID DISCHARGING HEAD
40-1, 40
40-5, 40
DISCHARGING MODULE
400-1, 400
400-4, 400
TEMPERATURE MEASUREMENT CIRCUIT
210
DRIVING SIGNAL SELECTION CIRCUIT
200
VOUT
600
60
DISCHARGING MODULE
50
DRIVING SIGNAL CREATION CIRCUIT
310a-1
COM-A1
310a-4
COM-A4
310b
COM-B
REFERENCE VOLTAGE SIGNAL CREATION CIRCUIT
320
VBS
330
VDD
GVDD
VOLTAGE CONVERSION CIRCUIT

| [SIH, SIL] | | [1, 1] LARGE DOT | [1, 0] MEDIUM DOT | [0, 1] SMALL DOT | [0, 0] NON-RECORDING |
|---|---|---|---|---|---|
| S1 | T1 | HIGH | HIGH | HIGH | LOW |
| | T2 | HIGH | LOW | LOW | LOW |
| S2 | T1 | LOW | LOW | LOW | HIGH |
| | T2 | LOW | HIGH | LOW | LOW |

LIQUID DISCHARGING APPARATUS AND DRIVING CIRCUIT BOARD

The present application is based on, and claims priority from, JP Application Serial Number 2018-181772, filed Sep. 27, 2018, the disclosure of which is hereby incorporated by reference herein in its entirety.

BACKGROUND

1. Technical Field

The present disclosure relates to a liquid discharging apparatus and a driving circuit board.

2. Related Art

A known ink jet printer (a type of liquid discharging apparatus) that discharges a liquid such as an ink uses, for example, piezoelectric elements. In a printer head (a type of liquid discharging head), these piezoelectric elements are provided in correspondence to a plurality of nozzles from which inks are discharged and to cavities that store the inks to be discharged from the nozzles. When a piezoelectric element is displaced in response to a driving signal, a vibrating plate provided between the piezoelectric element and the relevant cavity is displaced. Accordingly, the internal volume of the cavity changes and the ink stored in the cavity is thereby discharged from the relevant nozzles.

The liquid discharging apparatus disclosed in JP-A-2018-99865 has a plurality of driving circuits (driving signal creation circuits) that create driving signals. Two driving signals created by two driving signal creation circuits of the plurality of driving circuits are selectively supplied to the relevant piezoelectric element. Thus, the piezoelectric element is displaced, and the ink is discharged from the relevant nozzles.

However, in a liquid discharging apparatus demanded to achieve high landing precision or high-speed printing, a plurality of driving signals may be created in correspondence to a plurality of nozzle rows. That is, a liquid discharging apparatus may have a plurality of driving signal creation circuits to create driving signals corresponding to the plurality of nozzle rows. In this case, in the liquid discharging apparatus described in JP-A-2018-99865, two driving signals created by two driving signal creation circuits are supplied to one piezoelectric element or one nozzle row. When more nozzle rows are disposed, therefore, the number of driving signal creation circuits is noticeably increased. This may increase the size of the liquid discharging apparatus.

SUMMARY

A liquid discharging apparatus according to an aspect of the present disclosure has: a first driving signal creation circuit that creates a first driving signal; a second driving signal creation circuit that creates a second driving signal; a third driving signal creation circuit that creates a third driving signal; a liquid discharging head having a first piezoelectric element and a second piezoelectric element; and a circuit board having a first side, a second side opposite to the first side, a third side, and a fourth side opposite to the third side, the circuit board including the first driving signal creation circuit, second driving signal creation circuit, and third driving signal creation circuit. When the first piezoelectric element is driven in response to the first driving signal and third driving signal, the first piezoelectric element causes a liquid to be discharged from a first nozzle. When the second piezoelectric element is driven in response to the second driving signal and third driving signal, the second piezoelectric element causes a liquid to be discharged from a second nozzle. The first driving signal creation circuit has a first transistor that amplifies a signal based on a first base driving signal from which the first driving signal is created, and also has a first integrated circuit that controls the operation of the first transistor. The second driving signal creation circuit has a second transistor that amplifies a signal based on a second base driving signal from which the second driving signal is created, and also has a second integrated circuit that controls the operation of the second transistor. The third driving signal creation circuit has a third transistor that amplifies a signal based on a third base driving signal from which the third driving signal is created, and also has a third integrated circuit that controls the operation of the third transistor. The shortest distance between the first side and the first driving signal creation circuit is longer than the shortest distance between the first side and the third driving signal creation circuit. The shortest distance between the first side and the second driving signal creation circuit is longer than the shortest distance between the first side and the third driving signal creation circuit. The first integrated circuit and first transistor are positioned on the circuit board side by side in a direction away from the first side and toward the second side. The second integrated circuit and second transistor are positioned on the circuit board side by side in the direction away from the first side and toward the second side. The third integrated circuit and third transistor are positioned on the circuit board side by side in a direction away from the third side and toward the fourth side.

In an aspect of the liquid discharging apparatus: the circuit board may include an output connector that outputs the first driving signal, second driving signal, and third driving signal to the liquid discharging head; the shortest distance between the first driving signal creation circuit and the output connector may be shorter than the shortest distance between the third driving signal creation circuit and the output connector; and the shortest distance between the second driving signal creation circuit and the output connector may be shorter than the shortest distance between the third driving signal creation circuit and the output connector.

In an aspect of the liquid discharging apparatus: the circuit board may have a first wire, a second wire, and a third wire; the first wire may be electrically coupled to the third driving signal creation circuit; the second wire may branch from the first wire and may carry the third driving signal to the first piezoelectric element; and the third wire may branch from the first wire and may carry the third driving signal to the second piezoelectric element.

In an aspect of the liquid discharging apparatus, the third transistor may be larger in size than the first the transistor and may be larger in size than the second the transistor.

In an aspect of the liquid discharging apparatus, the third transistor may have the same size as at least any one of the first transistor and second the transistor.

In an aspect of the liquid discharging apparatus, the maximum value of a current that can be supplied to the third transistor may be larger than the maximum value of a current that can be supplied to the first transistor and may be larger than the maximum value of a current that can be supplied to the second transistor.

In an aspect of the liquid discharging apparatus, the maximum value of a current that can be supplied to the third transistor may be equal to at least any one of the maximum value of a current that can be supplied to the first transistor and the maximum value of a current that can be supplied to the second transistor.

In an aspect of the liquid discharging apparatus: the first driving signal creation circuit may have a first modulation circuit and a first demodulation circuit; the second driving signal creation circuit may have a second modulation circuit and a second demodulation circuit; the third driving signal creation circuit may have a third modulation circuit and a third demodulation circuit; the first demodulation circuit may be included in the first integrated circuit and may demodulate the first base driving signal to create a first modulated signal; the first transistor may amplify the first modulated signal to create a first amplified modulated signal; the first demodulation circuit may include a first coil and may demodulate the first amplified modulated signal according to the first coil to create the first driving signal; the second demodulation circuit may be included in the second integrated circuit and may demodulate the second base driving signal to create a second modulated signal; the second transistor may amplify the second modulated signal to create a second amplified modulated signal; the second demodulation circuit may include a second coil and may demodulate the second amplified modulated signal according to the second coil to create the second driving signal; the third demodulation circuit may be included in the third integrated circuit and may demodulate the third base driving signal to create a third modulated signal; the third transistor may amplify the third modulated signal to create a third amplified modulated signal; the third demodulation circuit may include a third coil and may demodulate the third amplified modulated signal according to the third coil to create the third driving signal; and the third coil may be larger in size than the first coil and may be larger in size than the second coil.

In an aspect of the liquid discharging apparatus: the first driving signal creation circuit may have a first modulation circuit and a first demodulation circuit; the second driving signal creation circuit may have a second modulation circuit and a second demodulation circuit; the third driving signal creation circuit may have a third modulation circuit and a third demodulation circuit; the first demodulation circuit may be included in the first integrated circuit and may demodulate the first base driving signal to create a first modulated signal; the first transistor may amplify the first modulated signal to create a first amplified modulated signal; the first demodulation circuit may include a first coil and may demodulate the first amplified modulated signal according to the first coil to create the first driving signal; the second demodulation circuit may be included in the second integrated circuit and may demodulate the second base driving signal to create a second modulated signal; the second transistor may amplify the second modulated signal to create a second amplified modulated signal; the second demodulation circuit may include a second coil and may demodulate the second amplified modulated signal according to the second coil to create the second driving signal; the third demodulation circuit may be included in the third integrated circuit and may demodulate the third base driving signal to create a third modulated signal; the third transistor may amplify the third modulated signal to create a third amplified modulated signal; the third demodulation circuit may include a third coil and may demodulate the third amplified modulated signal according to the third coil to create the third driving signal; and the third coil may have the same size as at least any one of the first coil and second coil.

A driving circuit board according to an aspect of the present disclosure has a driving circuit that drives a liquid discharging head having a first piezoelectric element that causes a liquid to be discharged from a first nozzle by being driven and also having a second piezoelectric element that causes a liquid to be discharged from a second nozzle by being driven. The driving circuit board has: a first driving signal creation circuit that creates a first driving signal; a second driving signal creation circuit that creates a second driving signal; a third driving signal creation circuit that creates a third driving signal; and a circuit board having a first side, a second side opposite to the first side, a third side, and a fourth side opposite to the third side, the circuit board including the first driving signal creation circuit, second driving signal creation circuit, and third driving signal creation circuit. The first driving signal drives the first piezoelectric element. The second driving signal drives the second piezoelectric element. The third driving signal drives the first piezoelectric element and second piezoelectric element. The first driving signal creation circuit has a first transistor that amplifies a signal based on a first base driving signal from which the first driving signal is created, and also has a first integrated circuit that controls the operation of the first transistor. The second driving signal creation circuit has a second transistor that amplifies a signal based on a second base driving signal from which the second driving signal is created, and also has a second integrated circuit that controls the operation of the second transistor. The third driving signal creation circuit has a third transistor that amplifies a signal based on a third base driving signal from which the third driving signal is created, and also has a third integrated circuit that controls the operation of the third transistor. The shortest distance between the first side and the first driving signal creation circuit is longer than the shortest distance between the first side and the third driving signal creation circuit. The shortest distance between the first side and the second driving signal creation circuit is longer than the shortest distance between the first side and the third driving signal creation circuit. The first integrated circuit and first transistor are positioned on the circuit board side by side in a direction away from the first side and toward the second side. The second integrated circuit and second transistor are positioned on the circuit board side by side in the direction away from the first side and toward the second side. The third integrated circuit and third transistor are positioned on the circuit board side by side in a direction away from the third side and toward the fourth side.

BRIEF DESCRIPTION OF THE DRAWINGS

FIG. 7 is a block diagram illustrating the electrical structure of the liquid discharging apparatus.

DESCRIPTION OF EXEMPLARY EMBODIMENTS

A preferred embodiment of the present disclosure will be described below with reference to the drawings. These drawings are for convenience of explanation. However, the embodiment described below does not unreasonably restrict the contents of the present disclosure, the contents being described in the scope of claims. All of the structures described below are not always essential structural requirements.

1 Overview of a Liquid Discharging Apparatus

The structure of a liquid discharging apparatus 1 in an embodiment will be described below with reference to FIGS. 1 to 4.

Figure 1:
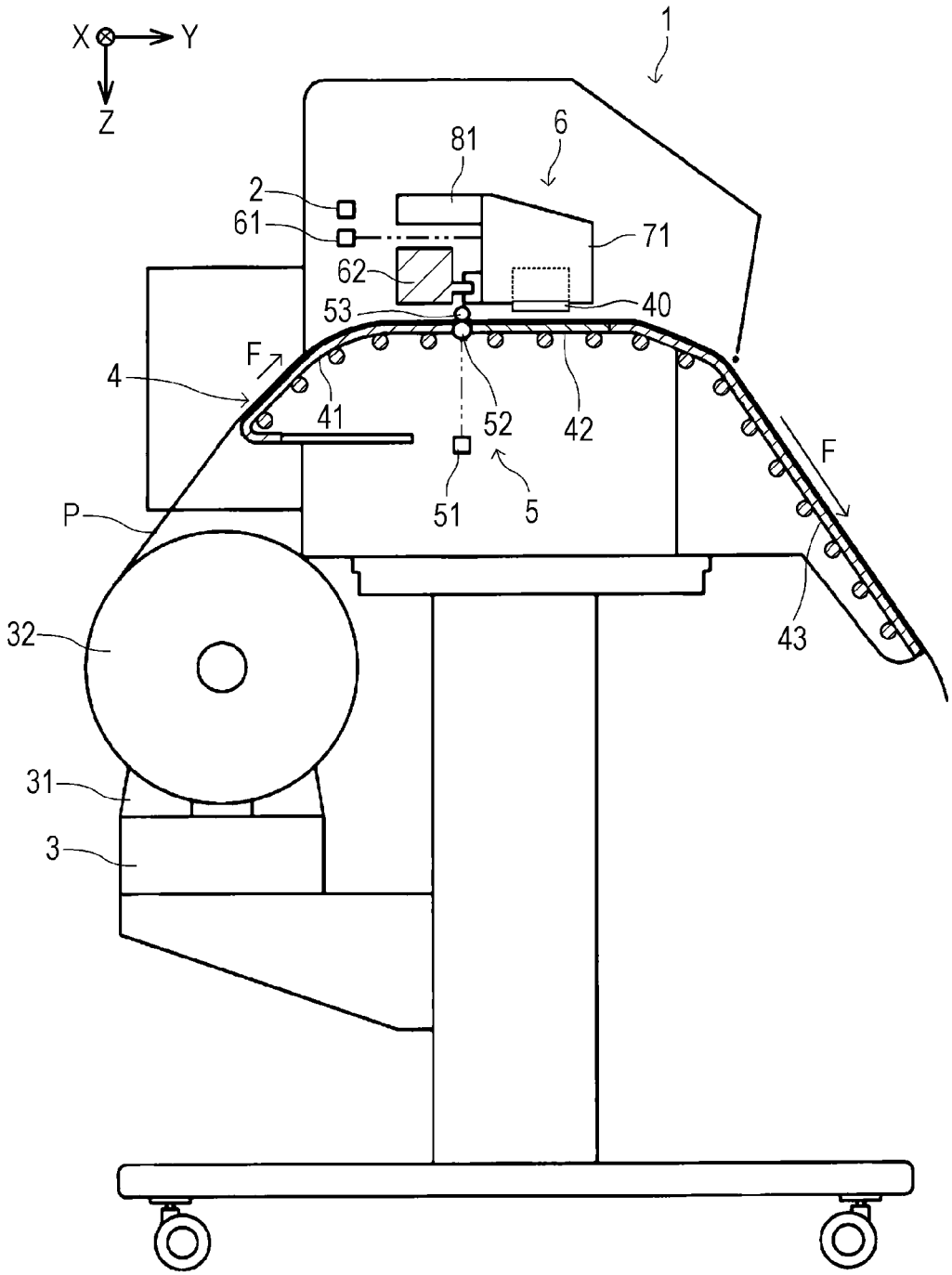
FIG. 1 is a side view illustrating the structure of a liquid discharging apparatus.
Figure 2:
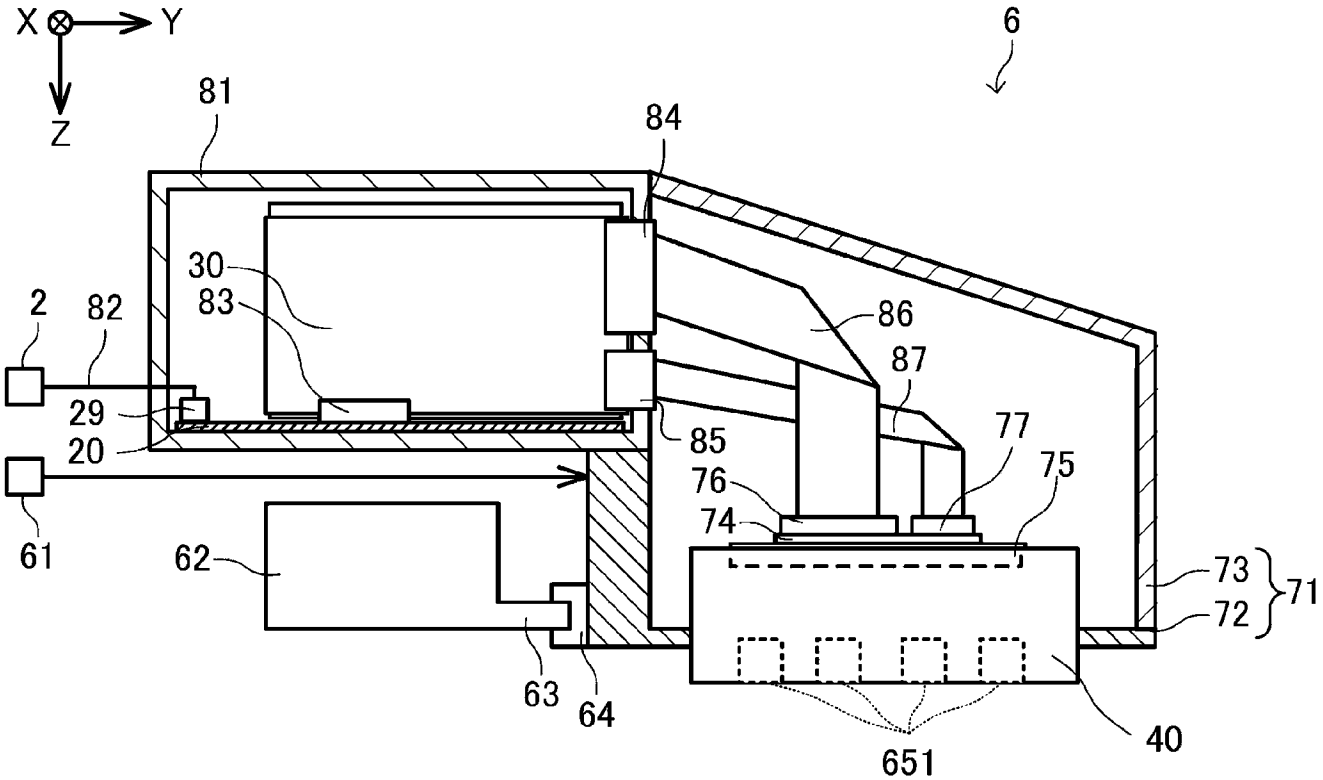
FIG. 2 is a side view illustrating the structure of the periphery of a printing section in the liquid discharging apparatus.
Figure 3:
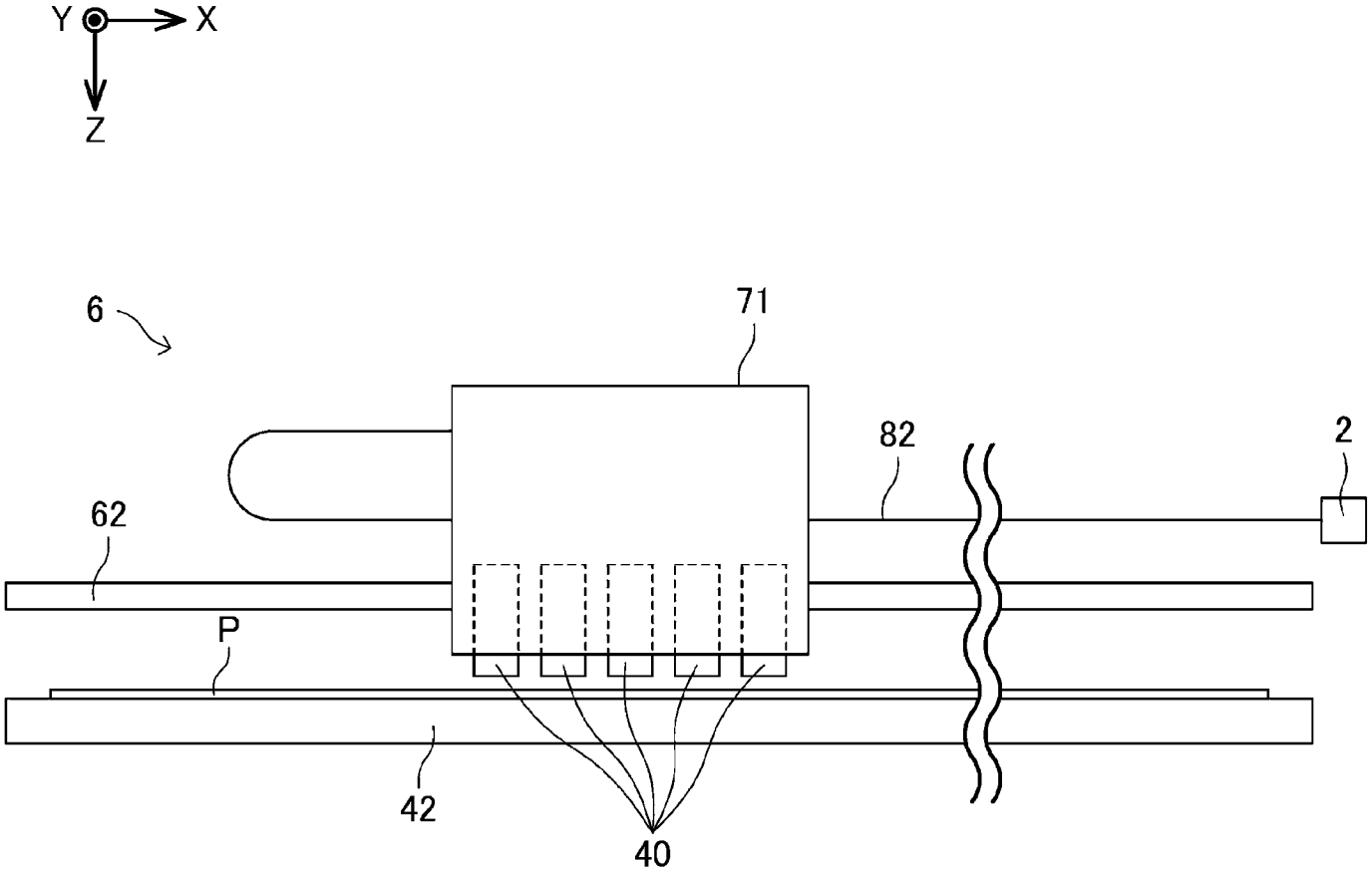
FIG. 3 is a front view illustrating the structure of the periphery of the printing section in the liquid discharging apparatus.
Figure 4:
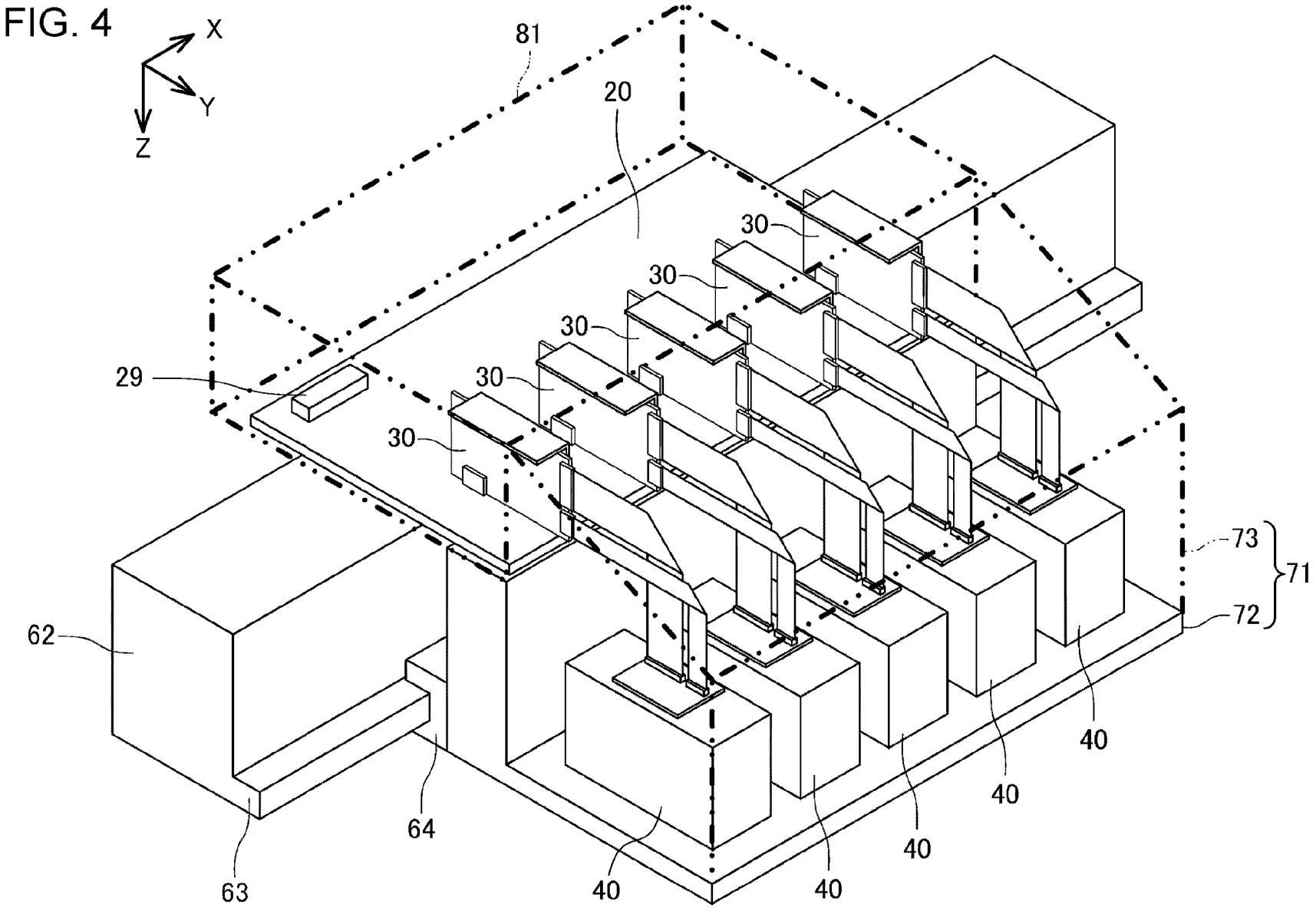
FIG. 4 is a perspective view illustrating the structure of the periphery of the printing section in the liquid discharging apparatus.

FIG. 1 is a side view illustrating the structure of the liquid discharging apparatus 1. FIG. 2 is a side view illustrating the structure of the periphery of a printing section 6 in the liquid discharging apparatus 1. FIG. 3 is a front view illustrating the structure of the periphery of the printing section 6 in the liquid discharging apparatus 1. FIG. 4 is a perspective view illustrating the structure of the periphery of the printing section 6 in the liquid discharging apparatus 1.

As illustrated in FIG. 1, the liquid discharging apparatus 1 has a feeder 3 that feeds a medium P, a support section 4 that supports the medium P, a transport section 5 that transports the medium P, a printing section 6 that performs printing on the medium P, and a controller 2 that controls these components.

In the description below, the width direction of the liquid discharging apparatus 1 will be referred to as the X direction, the depth direction of the liquid discharging apparatus 1 will be referred to as the Y direction, and the height direction of the liquid discharging apparatus 1 will be referred to as the Z direction. The direction in which the medium P is transported will be referred to as the transport direction F. The X direction, Y direction, and Z direction are mutual orthogonal. The transport direction F crosses the X direction.

The controller 2 is secured in the liquid discharging apparatus 1. The controller 2 creates various control signals used to control the liquid discharging apparatus 1 and outputs the control signals to relevant various structures.

The feeder 3 has a holding member 31 that rotatably holds a rolled body 32 formed by winding the medium P so as to be piled. The holding member 31 holds rolled bodies 32 of different types of media P and rolled bodies 32 having different dimensions in the X direction. When a rolled body 32 is rotated in one direction in the feeder 3, the medium P unwound from the rolled body 32 is fed out to the support section 4.

The support section 4 has a first support portion 41, a second support portion 42, and a third support portion 43, these support portions forming a transport path for the medium P from the upstream of the transport direction F toward its downstream. The first support portion 41 guides the medium P fed out from the feeder 3 toward the second support portion 42. The second support portion 42 supports the medium P when printing is performed on the medium P. The third support portion 43 guides the medium P on which printing has been performed toward the downstream of the transport direction F.

The transport section 5 has a transport roller 52 that gives a transport force to the medium P, a driven roller 53 that presses the medium P against the transport roller 52, and a rotation mechanism 51 that drives the transport roller 52.

The transport roller 52 is placed below, in the Z direction, the transport path for the medium P. The driven roller 53 is placed above, in the Z direction, the transport path for the medium P. The rotation mechanism 51 includes, for example, a motor and a reduction gear. When, in the transport section 5, the transport roller 52 is rotated with the medium P sandwiched between the transport roller 52 and the driven roller 53, the medium P is transported in the transport direction F.

As illustrated in FIGS. 2 and 3, the printing section 6 has a guide member 62 extending along the X direction, a carriage 71 supported by the guide member 62 so as to be movable along the X direction, five liquid discharging heads 40 mounted in the carriage 71, each liquid discharging head 40 discharging an ink (a type of liquid) to the medium P, and a moving mechanism 61 that moves the carriage 71 in the X direction. The printing section 6 further has a heat dissipating case 81. A relay circuit board 20 and five driving circuit boards 30 are accommodated in the heat dissipating case 81. Although, in the description below in this embodiment, it will be assumed that five driving circuit boards 30 and five liquid discharging heads 40 are provided in the carriage 71, the number of driving circuit boards 30 and the number of liquid discharging heads 40 are not limited to 5.

The carriage 71 has a carriage body 72, the cross section of which is substantially L-shaped when viewed from the X direction, and also has a carriage cover 73 removably attached to the carriage body 72. The carriage cover 73 forms a closed space together with the carriage body 72. At the bottom of the carriage 71, the five liquid discharging heads 40 are mounted at equal intervals in the X direction. The lower end of each liquid discharging head 40 protrudes from the lower surface of the carriage 71 to the outside. A plurality of nozzles 651 from which an ink is discharged are formed in the lower surface of each liquid discharging head 40.

The moving mechanism 61 has a motor and a reduction gear. The moving mechanism 61 converts the rotational force of the motor to a moving force with which the carriage 71 is moved in the X direction. When the moving mechanism 61 is driven, the carriage 71 is bidirectionally moved in the X direction in a state in which the five liquid discharging heads 40, five driving circuit boards 30, and relay circuit board 20 are mounted in the carriage 71.

As illustrated in FIGS. 2 and 4, the front end of the heat dissipating case 81 in a rectangular parallelepiped shape, in which the five driving circuit boards 30 and the relay circuit board 20 are accommodated, is secured to the upper end of the back of the carriage 71.

The relay circuit board 20 is mounted on the carriage 71 with the heat dissipating case 81 intervening between them. A connector 29 is provided on the relay circuit board 20.

The connector 29 is coupled to the controller 2 through a cable 82. That is, the cable 82 electrically couples the relay circuit board 20 mounted in the carriage 71, which bidirectionally moves in the X direction, to the controller 2 secured to the liquid discharging apparatus 1. Therefore, the cable 82 may be formed by using a flexible flat cable (FFC) or the like that can follow the bidirectional movement of the carriage 71 and can be deformed along with the bidirectional movement. The driving circuit boards 30 are erected above the relay circuit board 20 in the Z direction so as to be arranged side by side in a line in the X direction. The relay circuit board 20 and each driving circuit board 30 are coupled together with a connector 83 such as a board-to-board connector (BtoB).

The driving circuit boards 30 are mounted in the heat dissipating case 81 in a state in which they are arranged at equal intervals in the X direction. Connectors 84 and 85 are provided at the front end of each driving circuit board 30. The connectors 84 and 85 are each exposed from the front surface of the heat dissipating case 81.

One end of a cable 86 such as an FFC is removably coupled to the connector 84. One end of a cable 87 such as an FFC is removably coupled to the connector 85.

A coupling circuit board 74 is provide on the upper surface of each liquid discharging head 40. The coupling circuit board 74 is electrically coupled to the liquid discharging head 40 through a connector 75 such as a BtoB connector. Connectors 76 and 77 are provided on the coupling circuit board 74. Another end of the cable 86 is removably coupled to the connector 76. Another end of the cable 87 is removably coupled to the connector 77. Thus, the five driving circuit boards 30 and their corresponding five liquid discharging heads 40 are electrically coupled together.

As illustrated in FIGS. 2 and 4, the guide member 62 has a guide rail portion 63, which extends in the X direction, at the bottom of the front surface. The carriage 71 has a carriage support portion 64 at the bottom of the rear surface. The carriage support portion 64 is movably supported by the guide rail portion 63. Thus, the carriage 71 is slidably linked to the guide member 62.

As described above, in the liquid discharging apparatus 1, control signals created by the controller 2 secured to the main body of the liquid discharging apparatus 1 are input through the cable 82 to various components including the driving circuit boards 30 and liquid discharging head 40 mounted in the carriage 71, which is provided so as to be bidirectionally movable.

2 Structure of the Liquid Discharging Head

Figure 5:
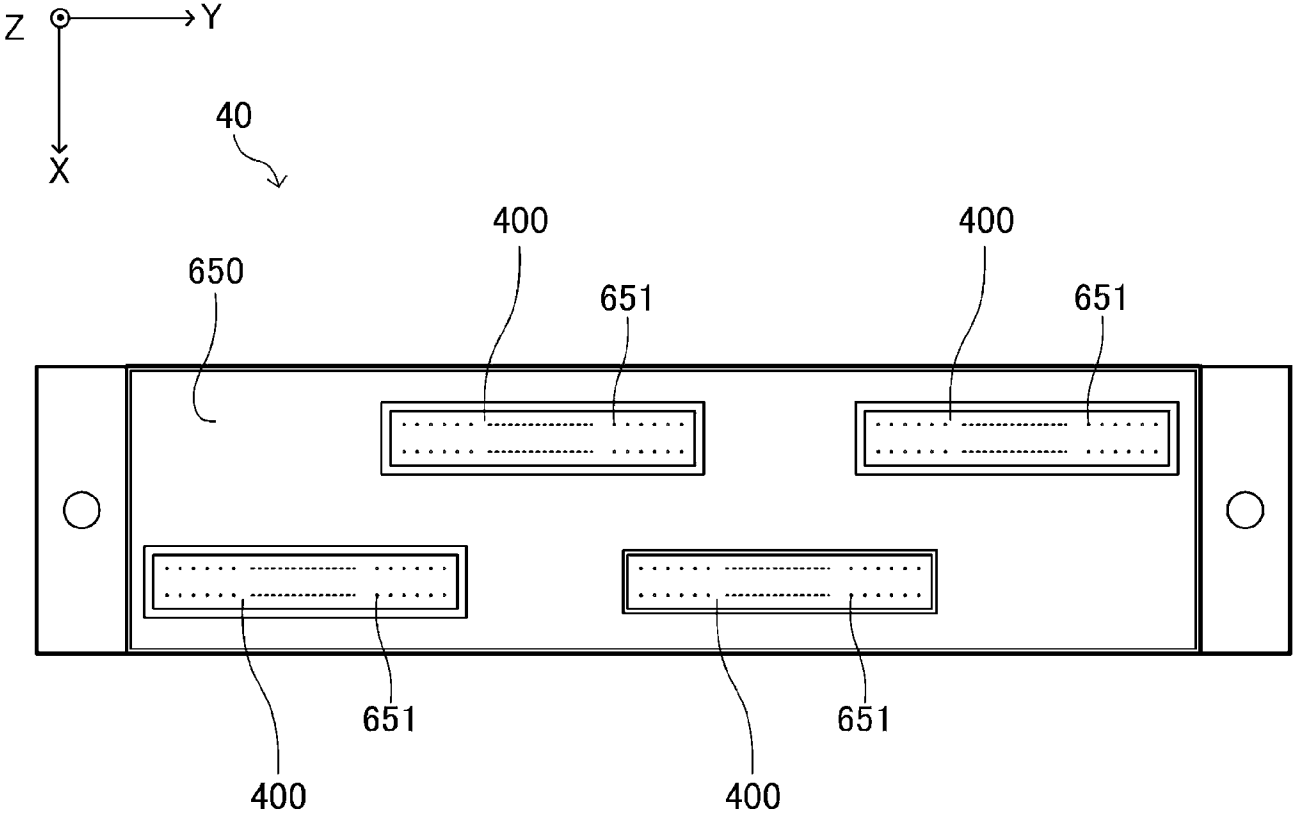
FIG. 5 illustrates the structure of an ink discharging surface.
Figure 6:
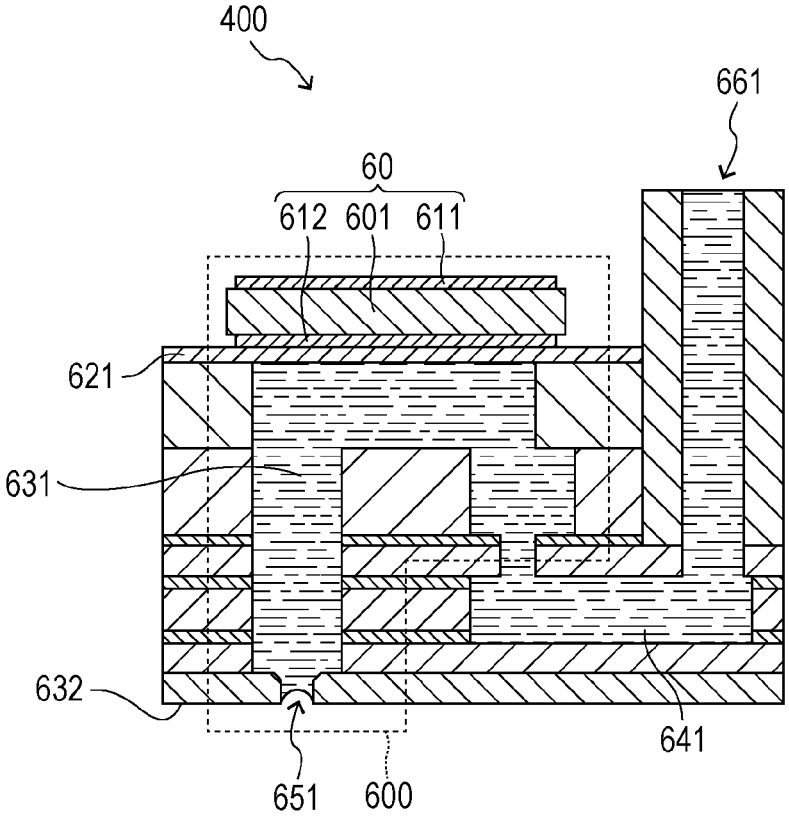
FIG. 6 schematically illustrates the structure of a discharging section including nozzles.

Next, the structure of the liquid discharging head 40 will be described. FIG. 5 illustrates the structure of an ink discharging surface 650 in which plurality of nozzles 651 from which an ink is discharged are formed in the liquid discharging head 40. FIG. 6 schematically illustrates the structure of a discharging section 600 including nozzles 651, the discharging section 600 being formed in a discharging module 400 included in the liquid discharging head 40. As illustrated in FIGS. 5 and 6, each of the plurality of liquid discharging heads 40 has piezoelectric elements 60 and nozzles 651.

As illustrated in FIG. 5, the liquid discharging head 40 has four discharging modules 400. In the liquid discharging head 40, these four discharging modules 400 are placed in a staggered state. In each discharging module 400, two rows of nozzles 651 are formed in the X direction; in each row, nozzles 651 is arranged side by side in a row in the Y direction. In the discharging module 400, 300 or more nozzles 651 are arranged per inch side by side in a row along the Y direction. Furthermore, in one discharging module 400, 600 or more nozzles 651 are formed. That is, 2400 or more nozzles 651 are formed in the liquid discharging head 40 in this embodiment. However, the number of discharging modules 400 included in the liquid discharging head 40 is not limited to 4.

As illustrated in FIG. 6, the discharging module 400 has a reservoir 641, besides the discharging sections 600 that include nozzles 651. An ink is supplied from an ink supply port 661 to the reservoir 641.

The discharging section 600 includes the piezoelectric element 60, a vibrating plate 621, a cavity 631, and the nozzles 651. In FIG. 6, the piezoelectric element 60 is disposed on the upper surface of the vibrating plate 621. When the piezoelectric element 60 is driven, the vibrating plate 621 is deformed. The vibrating plate 621 functions as a diaphragm that expands or contracts the internal volume of the cavity 631. The interior of the cavity 631 is filled with an ink. The cavity 631 is functions a pressure chamber the internal volume of which is changed when the piezoelectric element 60 is driven and the vibrating plate 621 is thereby deformed. The nozzle 651 is an opening formed in a nozzle plate 632 so as to communicate with the cavity 631. When the internal volume of the cavity 631 is changed, the ink stored in the cavity 631 is discharged from the nozzle 651.

The piezoelectric element 60 has a structure in which a piezoelectric body 601 is sandwiched between a pair of electrodes 611 and 612. With the piezoelectric element 60 in this structure, the central portions of the electrodes 611 and 612 and the vibrating plate 621 are warped with respect to their both ends in the upward direction or downward direction in FIG. 6, according to the potential difference between the electrode 611 and the electrode 612. Specifically, when the potential difference between the electrode 611 and the electrode 612 is reduced, the central portion of the piezoelectric element 60 is warped in the upward direction. When the potential difference between the electrode 611 and the electrode 612 is increased, the central portion of the piezoelectric element 60 is warped in the downward ward direction. When the piezoelectric element 60 is warped in the upward direction, the internal volume of the cavity 631 is expanded. Therefore, the ink is drawn from the reservoir 641 into the cavity 631. When the piezoelectric element 60 is warped in the downward direction, the internal volume of the cavity 631 is contracted. Therefore, the ink is discharged from the nozzles 651 by an amount depending on the extent to which the internal volume of the cavity 631 has been contracted. Therefore, the piezoelectric element 60 is driven by the potential difference between a voltage supplied to the electrode 611 and a voltage supplied to the electrode 612, as described above. When the piezoelectric element 60 is driven, the vibrating plate 621 is deformed and the ink is discharged from the corresponding nozzles 651. That is, when the piezoelectric element 60 is driven, the ink is discharged from the corresponding nozzles 651. However, the structure of the piezoelectric element 60 is not limited to the structure illustrated in the drawing. The piezoelectric element 60 only needs to be a type in which when the piezoelectric element 60 is driven, an ink can be discharged. The piezoelectric element 60 is not limited to bending vibration; the piezoelectric element 60 may have a structure in which vertical vibration is used.

3 Electrical Structure of the Liquid Discharging Apparatus

Next, the electrical structure of the liquid discharging apparatus 1 will be described. FIG. 7 is a block diagram illustrating the electrical structure of the liquid discharging apparatus 1. As illustrated in FIG. 7, the liquid discharging apparatus 1 has a control circuit board 10, the relay circuit board 20, five driving circuit boards 30, and five liquid discharging heads 40. The relay circuit board 20, five driving circuit boards 30, and five liquid discharging heads 40 are mounted in the carriage 71 as described above. In the description below, the five driving circuit boards 30 will sometimes be referred to as the driving circuit boards 30-1 to 30-5. Similarly, the five liquid discharging heads 40 will sometimes be referred to as the liquid discharging heads 40-1 to 40-5. In this embodiment, the driving circuit board **30-*i* (i is an integer from 1 to 5) and the liquid discharging head 40-*i* are disposed in correspondence to each other. That is, a signal created in the driving circuit board 30-*i* is supplied to the liquid discharging head 40-*i***.

The control circuit board 10 has a control circuit 100 and a voltage creation circuit 110, which are included in the controller 2 described above. The control circuit board 10 is electrically coupled to the relay circuit board 20 through the cable 82.

The voltage creation circuit 110 creates a voltage HVH used in the liquid discharging apparatus 1, the voltage HVH being, for example, 42 VDC, and outputs the voltage HVH to the relay circuit board 20 through the cable 82.

The control circuit 100 receives various types of signals such as image data from a host computer, creates, according to these signals, various types of control signals that control the operations of the five driving circuit boards 30 and five liquid discharging heads 40, and outputs the control signals to the relay circuit board 20 through the cable 82.

Specifically, the control circuit 100 creates a print data signal SI1, a latch signal LAT1, a change signal CH1, a clock signal SCK, and base driving signals dA1-1 to dA1-4 and dB1, which are all input to the driving circuit board 30-1, and outputs the created signals to the relay circuit board 20 through the cable 82. Similarly, the control circuit 100 creates a print data signal SIi, a latch signal LATi, a change signal CHi, a clock signal SCK, and base signals dAi-1 to dAi-4 and dB1, which are all input to the driving circuit board **30-*i*, and outputs the created signals to the relay circuit board 20 through the cable 82**.

The relay circuit board 20 is electrically coupled to the driving circuit boards 30-1 to 30-5 through the connector 83. The relay circuit board 20 receives various types of control signals and the voltage HVH from the control circuit board 10 and relays these signals and the voltage HVH to the driving circuit boards 30-1 to 30-5.

Various types of control signals transferred from the control circuit board 10 through the cable 82 to the relay circuit board 20 may be differential signals in serial form that are used in a low voltage differential signaling (LVDS) transfer mode, a low voltage positive emitter coupled logic (LVPECL) transfer mode, a current mode logic (CML) transfer mode, and the like. In this case, the control circuit board 10 may have a converting circuit that converts various types of signals to be transferred to the relay circuit board 20 to the above differential signals. The relay circuit board 20 may have a restoration circuit that restores the differential signals that the relay circuit board 20 has received.

The driving circuit board 30-1 has a driving circuit 50, a reference voltage signal creation circuit 320, and a voltage conversion circuit 330. The driving circuit 50 includes driving signal creation circuits **310*a*-1 to 310*a*-4 and 310*b*. The driving circuit board 30-1 is electrically coupled to the liquid discharging head 40-1 through the cables 86 and 87**.

The voltage HVH is input to the voltage conversion circuit 330. The voltage conversion circuit 330 converts the voltage value of the voltage HVH to create a voltage VDD at, for example, 3.3 VDC, used as a power supply voltage in various types of components provided in the liquid discharging head 40-1, after which the voltage conversion circuit 330 outputs the voltage VDD to the liquid discharging head 40-1 through the cable 86. Similarly, the voltage conversion circuit 330 converts the voltage value of the voltage HVH to create a voltage GVDD at, for example, 7.5 VDC, used to, for example, drive the driving signal creation circuits **310*a*-1 to 310*a*-4 and 310*b*, after which the voltage conversion circuit 330 outputs the voltage GVDD to the driving signal creation circuits 310*a*-1 to 310*a*-4 and reference voltage signal creation circuit 320. However, the voltage conversion circuit 330** may create signals having a plurality of voltage values other than described above.

The base driving signal dA1-1, voltage HVH, and voltage GVDD are input to the driving signal creation circuit **310*a*-1. The driving signal creation circuit 310*a*-1 creates a driving signal COM-A1 according to the base driving signal dA1-1, voltage HVH, and voltage GVDD that the driving signal creation circuit 310*a*-1 has received. The driving signal creation circuit 310*a*-1 then outputs the driving signal COM-A1 to the liquid discharging head 40-1 through the cable 86. Similarly, the base driving signals dA1-*j* (j is an integer from 1 to 4), voltage HVH, and voltage GVDD are input to the driving signal creation circuit 310*a*-*j*. The driving signal creation circuit 310*a*-*j* then creates a driving signal COM-Aj according to the base driving signal dA1-*j*, voltage HVH, and voltage GVDD that the driving signal creation circuit 310*a*-*j* has received. The driving signal creation circuit 310*a*-*j* then outputs the driving signal COM-Aj to the liquid discharging head 40-*j* through the cable 86. Similarly, the base driving signals dB1, voltage HVH, and voltage GVDD are input to the driving signal creation circuit 310*b*. The driving signal creation circuit 310*b* then creates a driving signal COM-B according to the base driving signal dB1, voltage HVH, and voltage GVDD that the driving signal creation circuit 310*b* has received. The driving signal creation circuit 310*b* then outputs the driving signal COM-B to the liquid discharging head 40-1 through the cable 86**.

The voltage GVDD is input to the reference voltage signal creation circuit 320. The reference voltage signal creation circuit 320 converts the voltage value of the voltage GVDD to create a reference voltage signal VBS at, for example, 6 VDC, after which the reference voltage signal creation circuit 320 outputs the reference voltage signal VBS to the liquid discharging head 40-1 through the cable 86.

The driving circuit board 30-1 receives the voltage HVH from the voltage creation circuit 110 and transfers the voltage HVH to the liquid discharging head 40-1 through the cable 86. The driving circuit board 30-1 also receives the print data signal SI1, latch signal LAT1, change signal CH1, and clock signal SCK from the control circuit board 10 and transfers these signals to the liquid discharging head 40-1 through the cable 87.

As described above, the driving circuit board 30-1 and liquid discharging head 40-1 are electrically coupled to each other through the cables 86 and 87. The cable 86 carries the driving signals COM-A1 to COM-A4, COM-B, voltages VDD and HVH, and reference voltage signal VBS to the liquid discharging head 40-1. The cable 87 carries the print data signal SI1, latch signal LAT1, change signal CH1, and clock signal SCK to the liquid discharging head 40-1. That is, the liquid discharging apparatus 1 has the cable 86 that carries the driving signals COM-A1 to COM-A4, COM-B, voltages VDD and HVH, and reference voltage signal VBS, which are high-voltage signals, and the cable 87 that carries the print data signal SI1, latch signal LAT1, change signal CH1, and clock signal SCK, which are low-voltage signals to control ink discharging and the like. Thus, it becomes possible to reduce the risk that high-voltage and low-voltage signals interfere with each other.

The liquid discharging head 40-1 has four discharging modules 400. These four discharging modules 400 will sometimes be referred to as the discharging modules 400-1 to 400-4.

The discharging modules 400-1 has a driving signal selection circuit 200, a temperature measurement circuit 210, and a plurality of discharging sections 600.

The driving signal selection circuit 200 is formed from, for example, an integrated circuit (IC) device. The driving signal selection circuit 200 receives the voltages HVH and VDD, print data signal SI1, latch signal LAT1, change signal CH1, and clock signal SCK, driving signals COM-A1 and COM-B, and reference voltage signal VBS.

The driving signal selection circuit 200 creates a driving signal VOUT by, according to the print data signal SI1, selecting or deselecting the driving signals COM-A1 and COM-B that the driving signal selection circuit 200 has received, at a timing stipulated by the latch signal LAT1 and change signal CH1. The driving signal VOUT created in the driving signal selection circuit 200 is supplied to the piezoelectric elements 60 included in the plurality of discharging sections 600. That is, the driving signal selection circuit 200 included in the discharging module 400-1 controls the supply of the driving signals COM-A1 and COM-B to the piezoelectric elements 60.

In the discharging module 400-1, the temperature measurement circuit 210 is disposed in the vicinity of the driving signal selection circuit 200. The temperature measurement circuit 210 measures the temperature of the driving signal selection circuit 200. The temperature measurement circuit 210 creates a temperature signal T1-1, which indicates a measurement result of the measured temperature, and outputs the temperature signal T1-1 to the control circuit 100. The control circuit 100 receives the temperature signal T1-1, creates the base driving signal dA1-1 compensated according to the temperature signal T1-1, and outputs the compensated base driving signal dA1-1 to the driving signal creation circuit 310*a*-1. The driving signal creation circuit 310*a*-1 receives the compensated base driving signal dA1-1 and, according to it, creates the driving signal COM-A1. That is, the driving signal creation circuit 310*a*-1 creates the driving signal COM-A1 having a waveform compensated according to a measurement result for temperature measured by the temperature measurement circuit 210 included in the discharging module 400-1.

The discharging modules 400-2 to 400-4 each have a structure similar to the structure of the discharging module 400-1 except only that driving signals that they receive are driving signals COM-A2 to COM-A4 and temperature signals that they output are temperature signals T1-2 to T1-4.

Specifically, the discharging module 400-2 creates the driving signal VOUT by causing the driving signal selection circuit 200 included in the discharging module 400-2 to select or deselect the driving signals COM-A2 and COM-B. The discharging module 400-2 then supplies the driving signal VOUT to the piezoelectric elements 60 included in the discharging module 400-2. The discharging module 400-3 creates the driving signal VOUT by causing the driving signal selection circuit 200 included in the discharging module 400-3 to select or deselect the driving signals COM-A3 and COM-B. The discharging module 400-3 then supplies the driving signal VOUT to the piezoelectric elements 60 included in the discharging module 400-3. The discharging module 400-4 creates the driving signal VOUT by causing the driving signal selection circuit 200 included in the discharging module 400-4 to select or deselect the driving signals COM-A4 and COM-B. The discharging module 400-4 then supplies the driving signal VOUT to the piezoelectric elements 60 included in the discharging module 400-4.

The temperature measurement circuit 210 included in each of the discharging modules 400-2, 400-3, and 400-4 measures the temperature of the driving signal selection circuit 200 included in each of the discharging modules 400-2, 400-3, and 400-4, and creates the temperature signal T1-2, T1-3, or T1-4 indicating a measurement result of the measured temperature. The temperature signals T1-2, T1-3, and T1-4 are output to the control circuit 100. The control circuit 100 creates the base driving signals dA1-2, dA1-3, and dA1-4, which have been respectively compensated according to the temperature signals T1-2, T1-3, and T1-4, and respectively outputs the base driving signals dA1-2, dA1-3, and dA1-4 to the driving signal creation circuit 310*a*-2, 310*a*-3, and 310*a*-4. The driving signal creation circuit 310*a*-2, 310*a*-3, and 310*a*-4 respectively create the driving signals COM-A2, COM-A3, and COM-A4 according to their respective base driving signals dA1-2, dA1-3, and dA1-4. That is, the driving signal creation circuit 310*a*-2 creates the driving signal COM-A2 having a waveform compensated according to a measurement result for temperature measured by the temperature measurement circuit 210 included in the discharging module 400-2, the driving signal creation circuit 310*a*-3 creates the driving signal COM-A3 having a waveform compensated according to a measurement result for temperature measured by the temperature measurement circuit 210 included in the discharging module 400-3, and the driving signal creation circuit 310*a*-4 creates the driving signal COM-A4 having a waveform compensated according to a measurement result for temperature measured by the temperature measurement circuit 210 included in the discharging module 400-4.

The control circuit 100 also creates the base driving signal dB1, which has been compensated according to the temperature signals T1-1 to T1-4 that the control circuit 100 has received, and outputs the base driving signal dB1 to the driving signal creation circuit 310*b*. Then, the driving signal creation circuit 310*b* creates the driving signal COM-B according to the compensated base driving signal dA1. That is, the driving signal creation circuit 310*b* creates the driving signal COM-B having a waveform compensated according to a measurement result for temperature measured by the temperature measurement circuit 210 included in each of the discharging modules 400-1 to 400-4. The control circuit 100 may create the base driving signal dB1 according to the average of the temperature signals T1-1 to T1-4. Alternatively, the control circuit 100 may create the base driving signal dB1 according to the sum of the temperature signals T1-1 to T1-4.

The liquid discharging head 40 may have a temperature measurement circuit different from the temperature measurement circuit 210 included in the discharging modules 400-1 to 400-4. Then, the control circuit 100 may create the base driving signal dB1 that has been compensated according to a measurement result obtained from the different temperature measurement circuit and may output the base driving signal dB1 to the driving signal creation circuit 310*b*.

As described above, the driving signal creation circuits 310*a*-1 to 310*a*-4 respectively create the driving signals COM-A1 to COM-A4 that have been compensated according to measurement results obtained from the temperature measurement circuit 210 provided in the respective discharging modules 400-1 to 400-4. In this case, the temperature measurement circuit 210 provided in the discharging module 400-1 measures temperature in the vicinity of the driving signal selection circuit 200 included in the discharging module 400-1, the temperature measurement circuit 210 provided in the discharging module 400-2 measures temperature in the vicinity of the driving signal selection circuit 200 included in the discharging module 400-2, the temperature measurement circuit 210 provided in the discharging module 400-3 measures temperature in the vicinity of the driving signal selection circuit 200 included in the discharging module 400-3, and the temperature measurement circuit 210 provided in the discharging module 400-4 measures temperature in the vicinity of the driving signal selection circuit 200 included in the discharging module 400-4. That is, the temperature measurement circuit 210 measures the temperatures of the discharging module 400 in which an ink to be discharged from nozzles 651. Therefore, the driving signal creation circuits 310*a*-1 to 310*a*-4 can respectively create the driving signals COM-A1 to COM-A4 that have been compensated in consideration of temperature-caused changes in the physical properties of the ink to be discharged. This makes it possible to improve precision with which an ink is discharged from the corresponding nozzles 651.

The driving signal COM-A1 is an example of a first driving signal. The driving signal creation circuit 310*a*-1 that creates the driving signal COM-A1 is an example of a first driving signal creation circuit. The driving signal COM-A2 is an example of a second driving signal. The driving signal creation circuit 310*a*-2 that creates the driving signal COM-A2 is an example of a second driving signal creation circuit. The driving signal COM-B is an example of a third driving signal. The driving signal creation circuit 310*b* that creates the driving signal COM-B is an example of a third driving signal creation circuit.

The piezoelectric element 60 that is included in the discharging module 400-1 and is driven according to the driving signal COM-A1 and driving signal COM-B is an example of a first piezoelectric element. The nozzle 651 from which an ink is discharged in response to the driving of the piezoelectric element 60 is an example of a first nozzle. The piezoelectric element 60 that is included in the discharging module 400-2 and is driven according to the driving signal COM-A2 and driving signal COM-B is an example of a second piezoelectric element. The nozzle 651 from which an ink is discharged in response to the driving of the piezoelectric element 60 is an example of a second nozzle.

The driving signal COM-A3 is another example of the second driving signal. The driving signal creation circuit 310*a*-3 that creates the driving signal COM-A3 is another example of the second driving signal creation circuit. The piezoelectric element 60 included in the discharging module 400-3 is another example of the second piezoelectric element. The nozzle 651 from which an ink is discharged in response to the driving of the piezoelectric element 60 is another example of the second nozzle.

The driving signal COM-A4 is another example of the second driving signal. The driving signal creation circuit 310*a*-4 that creates the driving signal COM-A4 is another example of the second driving signal creation circuit. The piezoelectric element 60 included in the discharging module 400-4 is another example of the second piezoelectric element. The nozzle 651 from which an ink is discharged in response to the driving of the piezoelectric element 60 is another example of the second nozzle.

The driving circuit boards 30-2 to 30-5 each have a structure similar to the structure of the driving circuit board 30-1 described above except only that the signals input to the driving circuit boards 30-2 to 30-5 differ from the signal input to the driving circuit board 30-1. Similarly, the liquid discharging heads 40-2 to 40-5 each have a structure similar to the structure of the liquid discharging head 40-1 described above except only that the signals input to the liquid discharging heads 40-2 to 40-5 differ from the signal input to the liquid discharging head 40-1. Therefore, descriptions of the driving circuit boards 30-2 to 30-5 and liquid discharging heads 40-2 to 40-5 will be omitted.

4 Structure and Operation of the Driving Signal Selection Circuit

Now, the operation of the driving signal selection circuit 200 will be described. In the description of the structure and operation of the driving signal selection circuit 200, print data signals SI1 to SI5, change signals CH1 to CH5, latch signals LAT1 to LATS, and driving signals COM-A1 to COM-A4, which are signals input to the driving signal selection circuit 200, will be respectively taken as the print data signal SI, change signal CH, latch signal LAT, and driving signal COM-A. That is, in the description below, the driving signal selection circuit 200 will be assumed to create the driving signal VOUT by selecting or deselecting the driving signals COM-A and COM-B that the driving signal selection circuit 200 has received, according to the print data signal SI, change signal CH, latch signal LAT, and clock signal SCK that the driving signal selection circuit 200 has received, and then outputs the created driving signal VOUT.

Figure 8:
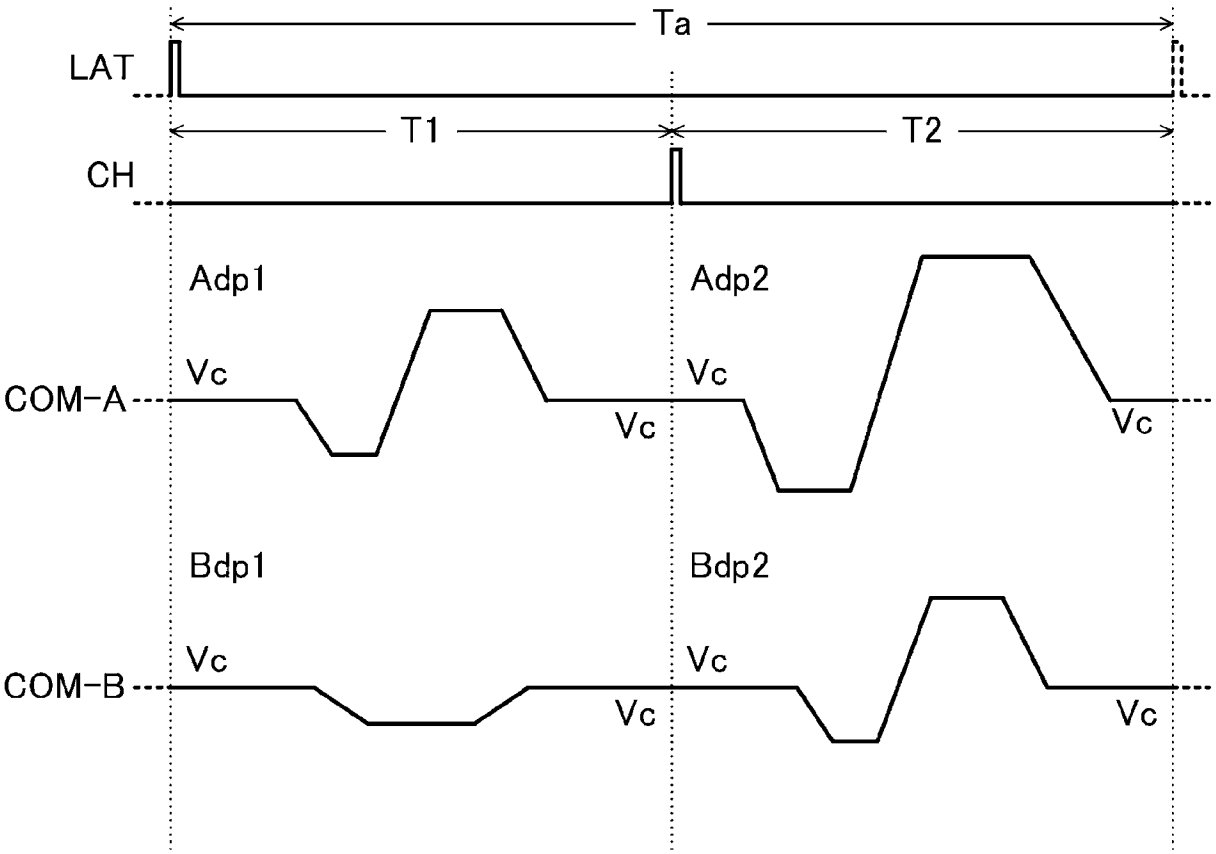
FIG. 8 illustrates an example of the waveforms of driving signals COM-A and COM-B.

FIG. 8 illustrates an example of the waveforms of the driving signals COM-A and COM-B. As illustrated in FIG. 8, the driving signal COM-A has a waveform in which a trapezoidal waveform Adp1 formed in a period T1 starting from a rising edge of the latch signal LAT until a rising edge of the change signal CH is continuous to a trapezoidal waveform Adp2 formed in a period T2 starting from the rising edge of the change signal CH until a next rising edge of the latch signal LAT. When the trapezoidal waveform Adp1 is supplied to one end of the piezoelectric element 60, a small amount of ink is discharged from the discharging section 600 corresponding to the piezoelectric element 60. When the trapezoidal waveform Adp2 is supplied to the one end of the piezoelectric element 60, a medium amount of ink, which is larger than the small amount of ink, is discharged from the discharging section 600 corresponding to the piezoelectric element 60.

The driving signal COM-B has a waveform in which a trapezoidal waveform Bdp1 formed in the period T1 is continuous to a trapezoidal waveform Bdp2 formed in the period T2. When the trapezoidal waveform Bdp1 is supplied to the one end of the piezoelectric element 60, no ink is discharged from the discharging section 600 corresponding to the piezoelectric element 60. This trapezoidal waveform Bdp1 causes the ink in the vicinity of the nozzle opening in the discharging section 600 to be subject to micro vibration to prevent an increase in the viscosity of the ink. When the trapezoidal waveform Bdp2 is supplied to the one end of the piezoelectric element 60, a small amount of ink is discharged from the discharging section 600 corresponding to the piezoelectric element 60 as when the trapezoidal waveform Adp1 is supplied. That is, the driving signal COM-B includes a waveform that drives the piezoelectric element 60 so that no ink is discharged from the nozzle 651.

The voltages at the timings at which the trapezoidal waveforms Adp1, Adp2, Bdp1, and Bdp2 start and end are the same; these voltages are Vc. That is, each of the trapezoidal waveforms Adp1, Adp2, Bdp1, and Bdp2 starts at the voltage Vc and ends at the voltage Vc. A cycle Ta composed of the period T1 and the period T2 is equivalent to a printing cycle during which a dot is formed on the medium P.

The waveforms of the driving signals COM-A and COM-B are not restricted to the waveforms illustrated in FIG. 8. Signals in which various waveforms are combined may be used according to the property of the ink to be discharged, the material of the medium P, the speed at which the carriage 71 in which the liquid discharging heads 40 are mounted moves, and the like.

Figure 9:
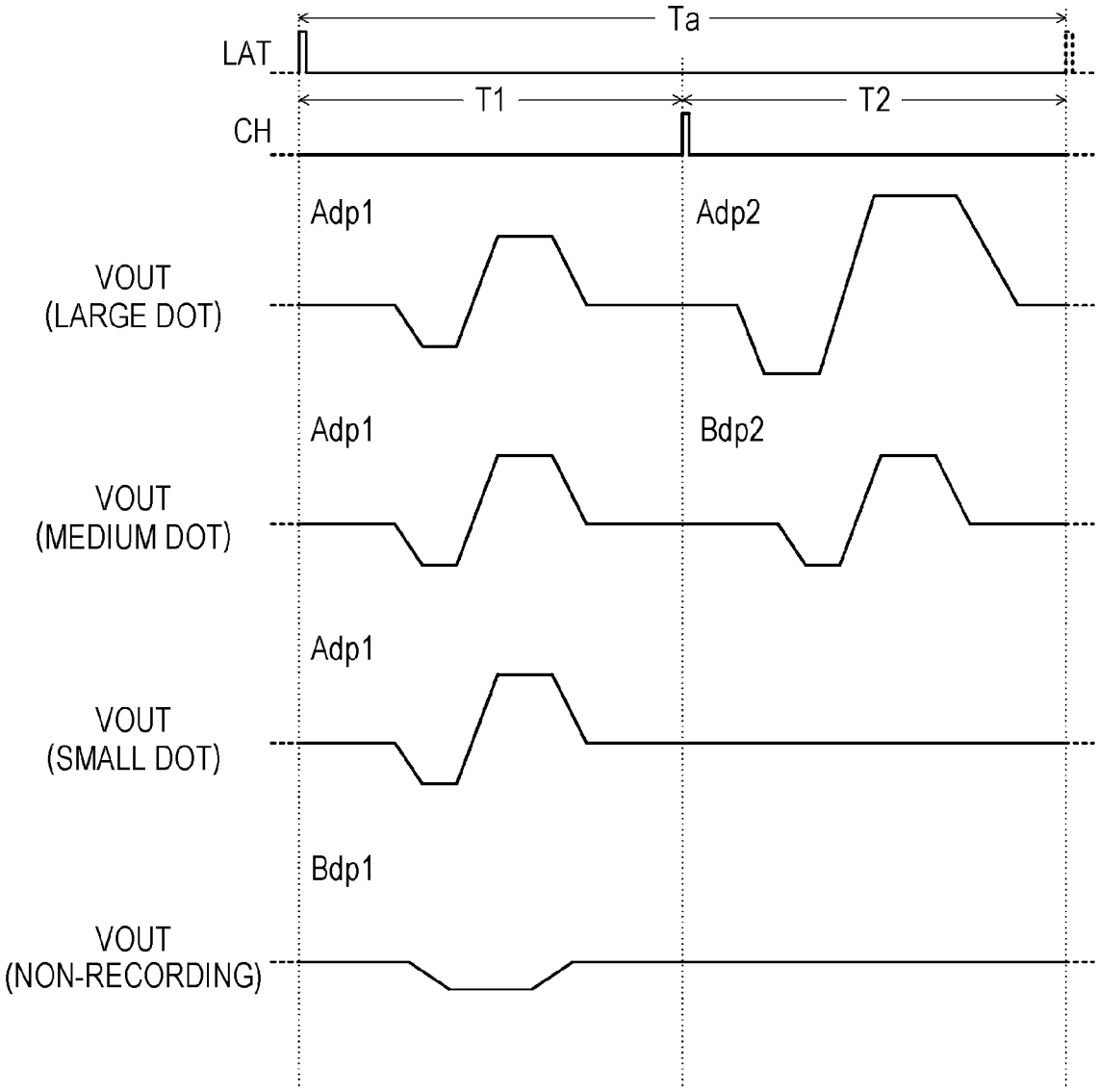
FIG. 9 illustrates an example of the waveforms of a driving signal VOUT.

FIG. 9 illustrates an example of the waveforms of the driving signals VOUT corresponding to the large dot, medium dot, and small dot formed on the medium P and to non-recording.

As illustrated in FIG. 9, the driving signal VOUT corresponding to the large dot has a waveform in which, in the cycle Ta, the trapezoidal waveform Adp1 formed in the period T1 is continuous to the trapezoidal waveform Adp2 formed in the period T2. When this driving signal VOUT is supplied to one end of the piezoelectric element 60, a small amount of ink and a medium amount of ink are discharged in the cycle Ta from the discharging section 600 corresponding to the piezoelectric element 60. Therefore, the small amount of ink and the medium amount of ink are landed and are combined on the medium P, forming the large dot.

The driving signal VOUT corresponding to the medium dot has a waveform in which, in the cycle Ta, the trapezoidal waveform Adp1 formed in the period T1 is continuous to the trapezoidal waveform Bdp2 formed in the period T2. When this driving signal VOUT is supplied to the one end of the piezoelectric element 60, a small amount of ink is discharged twice in the cycle Ta from the discharging section 600 corresponding to the piezoelectric element 60. Therefore, the small amounts of ink are landed and are combined on the medium P, forming the medium dot.

The driving signal VOUT corresponding to the small dot has a waveform in which, in the cycle Ta, the trapezoidal waveform Adp1 formed in the period T1 is continuous to a waveform formed in the period T2, the waveform being constant at the voltage Vc. When this driving signal VOUT is supplied to the one end of the piezoelectric element 60, a small amount of ink is discharged in the cycle Ta from the discharging section 600 corresponding to the piezoelectric element 60. Therefore, the small amount of ink is landed on the medium P, forming the small dot.

The driving signal VOUT corresponding to non-recording has a waveform in which, in the cycle Ta, the trapezoidal waveform Bdp1 formed in the period T1 is continuous to a waveform formed in the period T2, the waveform being constant at the voltage Vc. When this driving signal VOUT is supplied to the one end of the piezoelectric element 60, in the cycle Ta, the ink in the vicinity of the nozzle opening in the discharging section 600 corresponding to the piezoelectric element 60 is just subject to micro vibration and no ink is discharged. Therefore, no ink is landed on the medium P and any dot is not thereby formed.

The waveform constant at the voltage Vc is formed from the immediately previous voltage Vc held by the capacitive component of the piezoelectric element 60 in a state in which none of the trapezoidal waveforms Adp1, Adp2, Bdp1, and Bdp2 is selected as part or the whole of the driving signal VOUT. When none of the trapezoidal waveforms Adp1, Adp2, Bdp1, and Bdp2 is selected as part or the whole of the driving signal VOUT, therefore, the voltage Vc is supplied to the piezoelectric element 60 as the driving signal VOUT.

Figure 10:
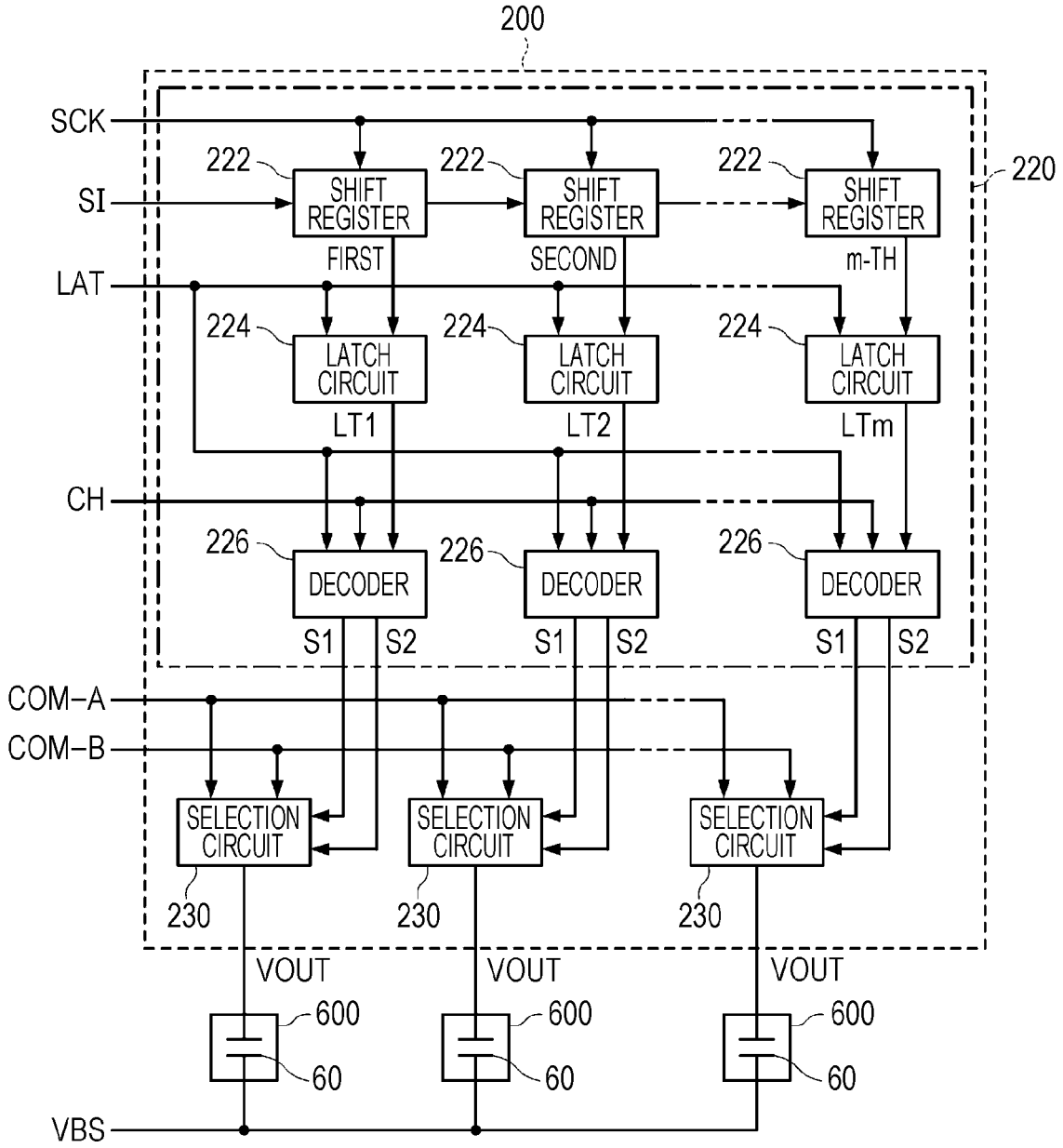
FIG. 10 illustrates the structure of a driving signal selection circuit.

Next, the structure and operation of the driving signal selection circuit 200 that selects the waveforms of the driving signals COM-A and COM-B to create the driving signal VOUT will be described. FIG. 10 illustrates the structure of the driving signal selection circuit 200. As illustrated in FIG. 10, the driving signal selection circuit 200 includes a selection control circuit 220 and a plurality of selection circuits 230.

The print data signal SI, latch signal LAT, change signal CH, and clock signal SCK are input to the selection control circuit 220. In the selection control circuit 220, a combination of a shift register 222, a latch circuit 224, and a decoder 226 is provided in correspondence to each of a plurality of discharging sections 600. That is, the driving signal selection circuit 200 includes the same number of combinations of shift registers 222, latch circuits 224, and decoders 226 as the total number m of corresponding discharging sections 600.

Specifically, the print data signal SI, which is synchronous with the clock signal SCK, is composed of a total of 2 m bits including two-bit print data [SIH, SIL] used to select any one of the large dot, medium dot, small dot, and non-recording for the discharging sections 600. The print data signal SI is held in the shift registers 222 in correspondence to the discharging sections 600 so that each two bits of print data [SIH, SIL] included in the print data signal SI are held in one shift register 222. Specifically, the m shift registers 222 corresponding to the discharging sections 600 are mutually cascaded and the print data signal SI is serially input and is successively transferred to later shift registers 222 according to clock signal SCK. In FIG. 10, to distinguish the m shift registers 222, they are represented as the first shift register 222, second shift register 222, . . . , and m-th shift registers 222 sequentially from the upstream from which the print data signal SI is input.

Each of the m latch circuits 224 latches the two-bit print data [SIH, SIL] held in the relevant shift register 222 of the m shift registers 222 on a rising edge of the latch signal LAT.

Figures 11, 12:
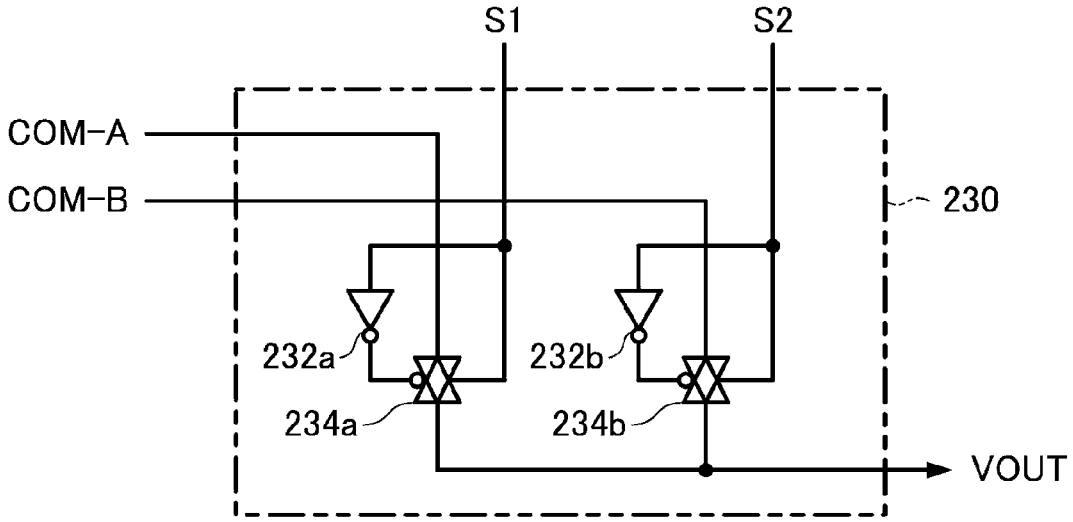
FIG. 11 illustrates decoding by a decoder.
FIG. 12 illustrates the structure of a selection circuit.

FIG. 11 illustrates decoding by the decoder 226. The decoder 226 outputs the selection signals S1 and S2 according to the latched two-bit print data [SIH, SIL]. For example, when the two-bit print data [SIH, SIL] is [1, 0], the decoder 226 outputs the selection signal S1 as a signal at a high logical level in the period T1 and at a low logical level in the period T2, and also outputs the selection signal S2 as a signal at a low logical level in the period T1 and at a high logical level in the period T2.

One selection circuit 230 is provided for each of the discharging sections 600. That is, the number of selection circuits 230 included in the driving signal selection circuit 200 is equal to the total number m of their corresponding discharging sections 600. FIG. 12 illustrates the structure of the selection circuit 230 corresponding to one discharging section 600. As illustrated in FIG. 12, the selection circuit 230 has inverters 232*a* and 232*b*, each of which is a NOT circuit, and transfer gates 234*a* and 234*b*.

The selection signal S1 is input to the positive control terminal of the transfer gate 234*a*, the terminal not being marked with a circle. At the same time, the logic of the selection signal S1 is inverted by the inverter 232*a* and the resulting signal is input to the negative control terminal of the transfer gate 234*a*, the terminal being marked with a circle. A driving signal COM-A is supplied to the input terminal of the transfer gate 234*a*. The selection signal S2 is input to the positive control terminal of the transfer gate 234*b*, the terminal not being marked with a circle. At the same time, the logic of the selection signal S2 is inverted by the inverter 232*b* and the resulting signal is input to the negative control terminal of the transfer gate 234*b*, the terminal being marked with a circle. A driving signal COM-B is supplied to the input terminal of the transfer gate 234*b*. The output terminals of the transfer gates 234*a* and 234*b* are coupled together and signals from these terminals are output as the driving signal VOUT.

Specifically, the transfer gate 234*a* creates a continuity (turned-on state) between the input terminal and the output terminal when the selection signal S1 is high and creates a non-continuity (turned-off state) between the input terminal and the output terminal when the selection signal S1 is low. Similarly, the transfer gate 234*b* creates a continuity (turned-on state) between the input terminal and the output terminal when the selection signal S2 is high and creates a non-continuity (turned-off state) between the input terminal and the output terminal when the selection signal S2 is low. Thus, the waveforms of the driving signals COM-A and COM-B are selected according to the selections signals S1 and S2, and the driving signal VOUT is output from the selection circuit 230.

Figure 13:
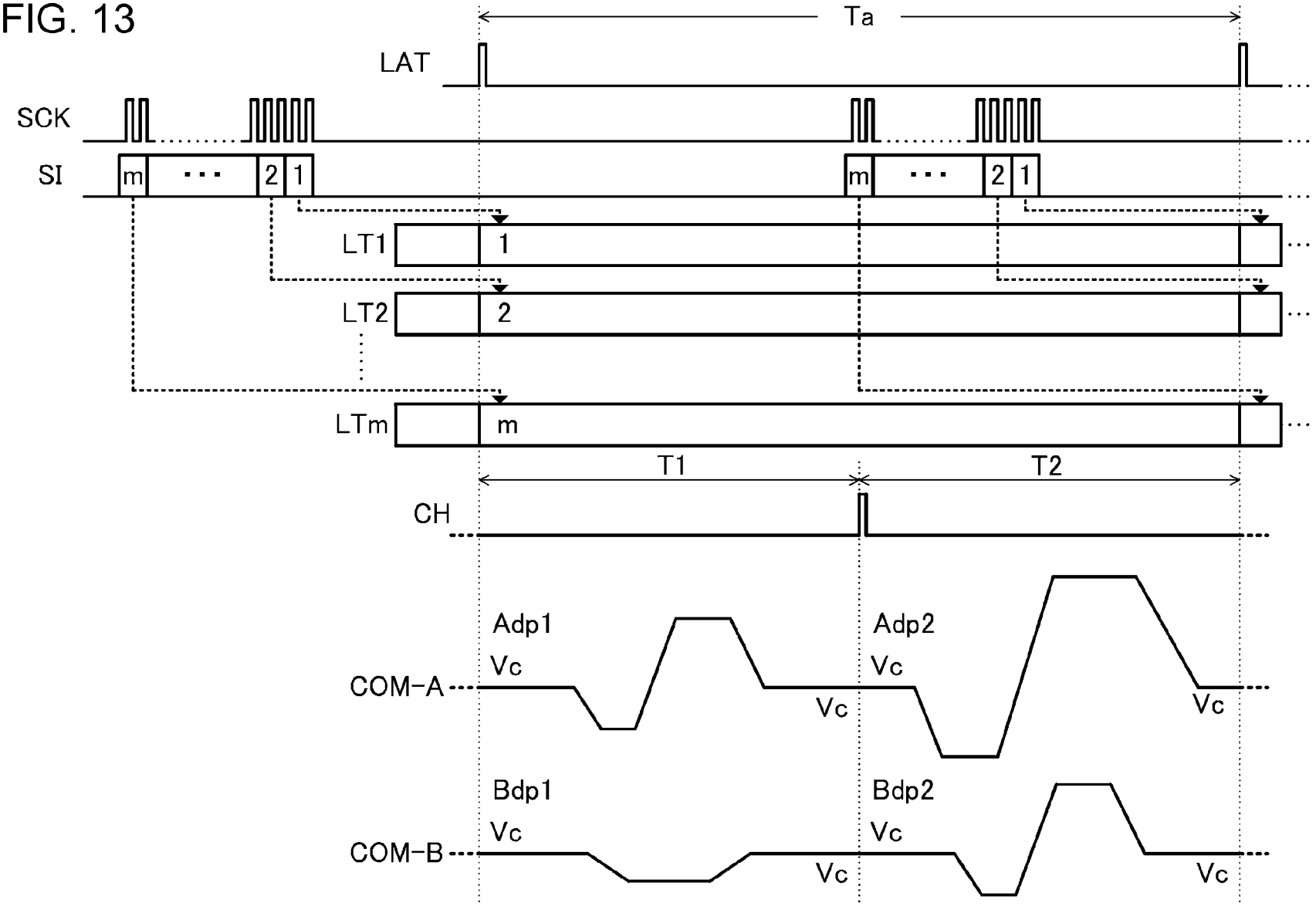
FIG. 13 illustrates the operation of the driving signal selection circuit.

Now, the operation of the driving signal selection circuit 200 will be described with reference to FIG. 13. FIG. 13 illustrates the operation of the driving signal selection circuit 200. The print data signal SI is serially input in synchronization with the clock signal SCK and is successively transferred in the shift registers 222 corresponding to the discharging sections 600. When the input of the clock signal SCK is stopped, two-bit print data [SIH, SIL] is held in each shift register 222 in correspondence to the relevant discharging section 600. The print data signal SI is input in an order corresponding to the discharging sections 600 for the m-th, . . . , second, and first shift registers 222.

When the latch signal LAT rises, all latch circuits 224 simultaneously latch the two-bit print data [SIH, SIL] held in their respective shift registers 222. LT1, LT2, . . . , and LTm in FIG. 13 indicate the two-bit pint data [SIH, SIL] latched by the latch circuits 224 corresponding to the first, second, . . . , and m-th shift registers 222.

The decoder 226 outputs the logic levels of the selection signals S1 and S2 in each of the periods T1 and T2 as illustrated in FIG. 11, according to the size of the dot stipulated by the latched two-bit print data [SIH, SIL].

Specifically, when the print data [SIH, SIL] is [1, 1], the decoder 226 causes the selection signal S1 to go high in both the periods T1 and T2 and causes the selection signal S2 to go low in both the periods T1 and T2. In this case, the selection circuit 230 selects the trapezoidal waveform Adp1 in the period T1 and the trapezoidal waveform Adp2 in the period T2. As a result, the driving signal VOUT corresponding to the large dot illustrated in FIG. 9 is created.

When the print data [SIH, SIL] is [1, 0], the decoder 226 causes the selection signal S1 to go high in the period T1 and to go low in the period T2 and causes the selection signal S2 to go low in the period T1 and to go high in the period T2. In this case, the selection circuit 230 selects the trapezoidal waveform Adp1 in the period T1 and the trapezoidal waveform Bdp2 in the period T2. As a result, the driving signal VOUT corresponding to the medium dot illustrated in FIG. 9 is created.

When the print data [SIH, SIL] is [0, 1], the decoder 226 causes the selection signal S1 to go high in the period T1 and to go low in the period T2 and causes the selection signal S2 to go low in both the periods T1 and T2. In this case, the selection circuit 230 selects the trapezoidal waveform Adp1 in the period T1 and does not select either of the trapezoidal waveform Adp2 and trapezoidal waveform Bdp2 in the period T2. As a result, the driving signal VOUT corresponding to the small dot illustrated in FIG. 9 is created.

When the print data [SIH, SIL] is [0, 0], the decoder 226 causes the selection signal S1 to go low in both the periods T1 and T2 and causes the selection signal S2 to go high in the period T1 and to go low in the period T2. In this case, the selection circuit 230 selects the trapezoidal waveform Bdp1 in the period T1 and does not select either of the trapezoidal waveform Adp2 and trapezoidal waveform Bdp2 in the period T2. As a result, the driving signal VOUT corresponding to non-recording illustrated in FIG. 9 is created.

As described above, the driving signal selection circuit 200 selects or deselects the two driving signals COM-A and COM-B according to the print data signal SI, latch signal LAT, change signal CH, and clock signal SCK, and supplies the driving signal VOUT matching the selection to each of the plurality of piezoelectric elements 60. That is, the driving signal selection circuit 200 controls the supply of the driving signals COM-A and COM-B to the piezoelectric elements 60.

5 Structure and Operation of the Driving Signal Creation Circuit

Figure 14:
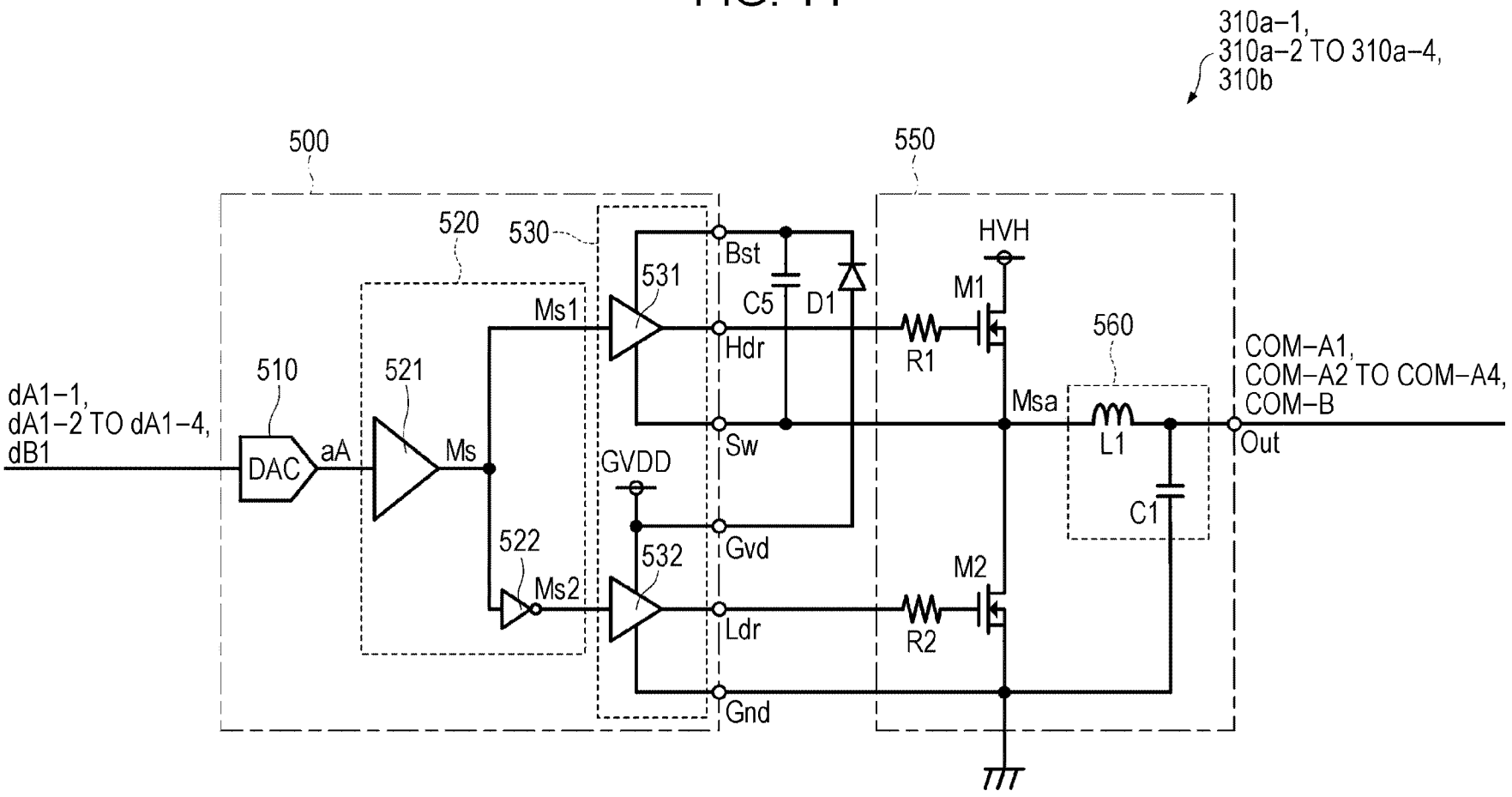
FIG. 14 illustrates the structure of a driving signal creation circuit.

Next, the structure and operation of the driving signal creation circuits 310*a*-1 to 310*a*-4 and 310*b* will be described. FIG. 14 illustrates the structure of the driving signal creation circuit 310-*a*. The base driving signal dA1-1 is input to the driving signal creation circuit 310*a*-1. Then, the driving signal creation circuit 310*a*-1 uses a modulation circuit 520 included in an integrated circuit device 500 to demodulate the base driving signal dA1-1 and create a modulated signal Ms. Transistors M1 and M2 amplify the modulated signal Ms to create an amplified modulated signal Msa. A low-pass filter circuit 560 demodulates the amplified modulated signal Msa according to a coil L1 to create the driving signal COM-A1.

As illustrated in FIG. 14, the driving signal creation circuit 310*a*-1 includes the integrated circuit device 500, an output circuit 550, and a plurality of circuit elements. The integrated circuit device 500 outputs gate signals that drive the transistors M1 and M2 included in the output circuit 550 according to the base driving signal dA1-1 that the driving signal creation circuit 310*a*-1 has received. The integrated circuit device 500 includes a digital-to-analog converter (DAC) 510, the modulation circuit 520, and a gate drive circuit 530.

The base driving signal dA1-1 is input to the DAC 510. The DAC 510 then converts the base driving signal dA1-1 from digital to analog to create a base driving signal aA, which is an analog signal. When the voltage of this base driving signal aA is amplified, it becomes the driving signal COM-A1. In other words, the base driving signal aA is a target signal before the driving signal COM-A1 is amplified.

The modulation circuit 520 includes a comparator 521 and an inverter circuit 522. The base driving signal aA is input to the comparator 521. Then, the comparator 521 outputs the modulated signal Ms that goes high when the voltage value of the base driving signal aA reaches or exceeds a predetermined voltage threshold Vth1 while the voltage value is rising and goes low when the voltage value of the base driving signal aA falls to or below a predetermined voltage threshold Vth2 while the voltage value is falling. The voltage threshold Vth1 and voltage threshold Vth2 are set so that the voltage threshold Vth1 is higher than the voltage threshold Vth2.

The modulated signal Ms output from the comparator 521 is branched in the modulation circuit 520, after which one of the branched signals of the modulated signal Ms is output to the gate drive circuit 530 as a modulated signal Ms1. Another of the branched signals of the modulated signal Ms is output to the gate drive circuit 530 through the inverter circuit 522 as a modulated signal Ms2. That is, the modulation circuit 520 creates two modulated signals Ms1 and Ms2, which are at exclusive logic levels, and outputs the created modulated signals Ms1 and Ms2 to the gate drive circuit 530. Here, two signals at exclusive logic levels include signals for which timings are controlled so that the logic levels of these signals do not go high at the same time. In the narrow sense, the modulated signal referred to here is the modulated signal Ms. When the modulated signal is considered to have been pulse-modulated according to the base driving signal aA, however, the modulated signal Ms2, which is a NOT signal of the modulated signal Ms, is also included in modulated signals.

The gate drive circuit 530 includes a gate driver 531 and a gate driver 532. The gate driver 531 level-shifts the voltage value of the modulated signal Ms1 output from the modulation circuit 520 and outputs the resulting signal from a terminal Hdr. Specifically, a voltage is supplied to the high-potential side of the power supply voltage of the gate driver 531 through a terminal Bst and a voltage is supplied to the low-potential side through a terminal Sw. The terminal Bst is coupled to one end of a capacitor C5 and to the cathode terminal of a diode D1 that prevents a backward flow, the capacitor C5 and diode D1 being disposed outside the integrated circuit device 500. Another end of the capacitor C5 is coupled to the terminal Sw. The anode terminal of the diode D1 is coupled to a terminal Gvd. A voltage GVDD created in the voltage conversion circuit 330 described above is supplied to the terminal Gvd. Therefore, the potential difference between the terminal Bst and the terminal Sw is substantially equal to the potential difference between the both ends of the capacitor C5, that is, the voltage GVDD. The gate driver 531 creates a signal having a voltage value that is larger than the voltage value at the terminal Sw by the voltage GVDD according to the modulated signal Ms1 that the gate driver 531 has received, after which the gate driver 531 outputs the created signal from the terminal Hdr.

The gate driver 532 operates on a lower potential than the gate driver 531 is. The gate driver 532 level-shifts the voltage value of the modulated signal Ms2 output from the modulation circuit 520 and outputs the resulting signal from a terminal Ldr. Specifically, the voltage GVDD is supplied to the high-potential side of the power supply voltage of the gate driver 532 and the ground potential is supplied to the low-potential side. The gate driver 532 creates a signal having a voltage value that is larger than the voltage value at a terminal Gnd by the voltage GVDD according to the modulated signal Ms2 that the gate driver 532 has received, after which the gate driver 532 outputs the created signal from the terminal Ldr.

The output circuit 550 has the transistors M1 and M2, resistors R1 and R2, and the low-pass filter 560. Each of the transistors M1 and M2 is, for example, an N-channel field effect transistor (FET).

The voltage HVH is supplied to the drain electrode of the transistor M1. The gate electrode of the transistor M1 is coupled to one end of the resistor R1. Another end of the resistor R1 is coupled to the terminal Hdr. The source electrode of the transistor M1 is coupled to the terminal Sw. The transistor M1 coupled as described above operates according to the output signal from the gate driver 531, the output signal being output from the terminal Hdr.

The drain electrode of the transistor M2 is coupled to the source electrode of the transistor M1. The gate electrode of the transistor M2 is coupled to one end of the resistor R2. Another end of the resistor R2 is coupled to the terminal Ldr. The ground potential is supplied to the source electrode of the transistor M2. The transistor M2 coupled as described above operates according to the output signal from the gate driver 532, the output signal being output from the terminal Ldr.

When the transistor M1 is controlled so as to be turned off and the transistor M2 is controlled so as to be turned on, a point to which the terminal Sw is coupled is at the ground level. Therefore, the voltage GVDD is supplied to the terminal Bst. When the transistor M1 is controlled so as to be turned on and the transistor M2 is controlled so as to be turned off, the voltage HVH is supplied to the point to which the terminal Sw is coupled. Therefore, the sum of the voltage HVH and voltage GVDD is supplied to the terminal Bst.

That is, since the voltage of the terminal Sw is changed to the ground potential or voltage HVH according to the operations of the transistors M1 and M2 with the capacitor C5 used as a floating power supply, the gate driver 531 that drives the transistor M1 supplies, to the gate electrode of the transistor M1, a signal the low level of which is the voltage HVH and the high level of which is the sum of the voltage HVH and voltage GVDD. The transistor M1 performs switching operation in response to the signal supplied to the gate electrode. The gate driver 532 that drives the transistor M2 supplies, to the gate electrode of the transistor M2, a signal the low level of which is the ground potential and the high level of which is the voltage GVDD to the gate electrode of the transistor M2, regardless of the operations of the transistors M1 and M2. The transistor M2 performs switching operation in response to the signal supplied to the gate electrode. Thus, the amplified modulated signal Msa, resulting from amplifying the modulated signal Ms according to the voltage HVH, is supplied to a point at which the source electrode of the transistor M1 and the drain electrode of the transistor M2 are coupled together. That is, the transistors M1 and M2 amplifies a signal based on the base driving signal dA1-1 from which the driving signal COM-A1 is created.

The low-pass filter circuit 560 includes the coil L1 and a capacitor C1. One end of the coil L1 is coupled to the source electrode of the transistor M1 and to the drain electrode of the transistor M2. Another end of the coil L1 is coupled to a terminal Out to which the driving signal COM-A is output and to one end of the capacitor C1. The ground potential is supplied to another end of the capacitor C1.

The coil L1 and capacitor C1 coupled as described above smooth the amplified modulated signal Msa supplied to the point at which the transistors M1 and M2 are coupled together. Thus, the amplified modulated signal Msa is demodulated and the driving signal COM-A is created. That is, the driving signal COM-A1 is created by demodulating the amplified modulated signal Msa according to the coil L1. The created driving signal COM-A1 is output from the terminal Out.

In the driving signal creation circuit 310*a*-1 structured as described above: the base driving signal dA1-1 is an example of a first base driving signal; the modulation circuit 520 that modulates the base driving signal dA1-1 is an example of a first modulation circuit; the integrated circuit device 500 including the modulation circuit 520 is an example of a first integrated circuit; the modulated signal Ms created by the modulation circuit 520 is an example of a first modulated signal; the transistor M1 that amplifies the modulated signal Ms1, which is one of the branched signals of the modulated signal Ms, is an example of a first transistor; the transistor M2 that amplifies the modulated signal Ms2, which is created by passing the other of the signals of the branched modulated signals Ms through the inverter circuit 522, is another example of the first transistor; the amplified modulated signal Msa created by amplifying the modulated signal Ms is an example of a first amplified modulated signal; the low-pass filter circuit 560 that demodulates the amplified modulated signal Msa is an example of a first demodulation circuit; and the coil L1 included in the low-pass filter circuit 560 is an example of a first coil.

The driving signal creation circuits 310*a*-2 to 310*a*-4 and 310*b* have a structure similar to the structure of the driving signal creation circuit 310*a*-1 except only that they receive different base driving signals and output different driving signals.

Specifically, in the driving signal creation circuit 310*a*-2, the modulation circuit 520 included in the integrated circuit device 500 modulates the base driving signal dA1-2 that has been input to the driving signal creation circuit 310*a*-2 to create the modulated signal Ms. Then, the transistors M1 and M2 amplify the modulated signal Ms to create the amplified modulated signal Msa, and the low-pass filter circuit 560 demodulates the amplified modulated signal Msa according to the coil L1 to create the driving signal COM-A2.

In the driving signal creation circuit 310*a*-2 structured as described above: the base driving signal dA1-2 is an example of a second base driving signal; the modulation circuit 520 that modulates the base driving signal dA1-2 is an example of a second modulation circuit; the integrated circuit device 500 including the modulation circuit 520 is an example of a second integrated circuit; the modulated signal Ms created by the modulation circuit 520 is an example of a second modulated signal; the transistor M1 that amplifies the modulated signal Ms1, which is one of the signals of the branched modulated signals Ms, is an example of a second transistor; the transistor M2 that amplifies the modulated signal Ms2, which is created by passing the other of the branched signals of the modulated signal Ms through the inverter circuit 522, is another example of the second transistor; the amplified modulated signal Msa created by amplifying the modulated signal Ms is an example of a second amplified modulated signal; the low-pass filter circuit 560 that demodulates the amplified modulated signal Msa is an example of a second demodulation circuit; and the coil L1 included in the low-pass filter circuit 560 is an example of a second coil.

In the driving signal creation circuit 310*a*-3, the modulation circuit 520 included in the integrated circuit device 500 modulates the base driving signal dA1-3 that has been input to the driving signal creation circuit 310*a*-3 to create the modulated signal Ms. Then, the transistors M1 and M2 amplify the modulated signal Ms to create the amplified modulated signal Msa, and the low-pass filter circuit 560 demodulates the amplified modulated signal Msa according to the coil L1 to create the driving signal COM-A3.

In the driving signal creation circuit 310*a*-3 structured as described above: the base driving signal dA1-3 is another example of the second base driving signal; the modulation circuit 520 that modulates the base driving signal dA1-3 is another example of the second modulation circuit; the integrated circuit device 500 including the modulation circuit 520 is another example of the second integrated circuit; the modulated signal Ms created by the modulation circuit 520 is another example of the second modulated signal; the transistor M1 that amplifies the modulated signal Ms1, which is one of the signals of the branched modulated signals Ms, is another example of the second transistor; the transistor M2 that amplifies the modulated signal Ms2, which is created by passing the other of the branched signals of the modulated signal Ms through the inverter circuit 522, is another example of the second transistor; the amplified modulated signal Msa created by amplifying the modulated signal Ms is another example of the second amplified modulated signal; the low-pass filter circuit 560 that demodulates the amplified modulated signal Msa is another example of the second demodulation circuit; and the coil L1 included in the low-pass filter circuit 560 is another example of the second coil.

In the driving signal creation circuit 310*a*-4, the modulation circuit 520 included in the integrated circuit device 500 modulates the base driving signal dA1-4 that has been input to the driving signal creation circuit 310*a*-4 to create the modulated signal Ms. Then, the transistors M1 and M2 amplify the modulated signal Ms to create the amplified modulated signal Msa, and the low-pass filter circuit 560 demodulates the amplified modulated signal Msa according to the coil L1 to create the driving signal COM-A4.

In the driving signal creation circuit 310*a*-4 structured as described above: the base driving signal dA1-4 is another example of the second base driving signal; the modulation circuit 520 that modulates the base driving signal dA1-4 is another example of the second modulation circuit; the integrated circuit device 500 including the modulation circuit 520 is another example of the second integrated circuit; the modulated signal Ms created by the modulation circuit 520 is another example of the second modulated signal; the transistor M1 that amplifies the modulated signal Ms1, which is one of the signals of the branched modulated signals Ms, is another example of the second transistor; the transistor M2 that amplifies the modulated signal Ms2, which is created by passing the other of the branched signals of the modulated signal Ms through the inverter circuit 522, is another example of the second transistor; the amplified modulated signal Msa created by amplifying the modulated signal Ms is another example of the second amplified modulated signal; the low-pass filter circuit 560 that demodulates the amplified modulated signal Msa is another example of the second demodulation circuit; and the coil L1 included in the low-pass filter circuit 560 is another example of the second coil.

In the driving signal creation circuit 310*b*, the modulation circuit 520 included in the integrated circuit device 500 modulates the base driving signal dB1 that has been input to the driving signal creation circuit 310*b* to create the modulated signal Ms. Then, the transistors M1 and M2 amplify the modulated signal Ms to create the amplified modulated signal Msa, and the low-pass filter circuit 560 demodulates the amplified modulated signal Msa according to the coil L1 to create the driving signal COM-B.

In the driving signal creation circuit 310*b* structured as described above: the base driving signal dB1 is an example of a third base driving signal; the modulation circuit 520 that modulates the base driving signal dB1 is an example of a third modulation circuit; the integrated circuit device 500 including the modulation circuit 520 is an example of a third integrated circuit; the modulated signal Ms created by the modulation circuit 520 is an example of a third modulated signal; the transistor M1 that amplifies the modulated signal Ms1, which is one of the branched signals of the modulated signal Ms, is an example of a third transistor; the transistor M2 that amplifies the modulated signal Ms2, which is created by passing the other of the signals of the branched modulated signals Ms through the inverter circuit 522, is another example of the third transistor; the amplified modulated signal Msa created by amplifying the modulated signal Ms is an example of a third amplified modulated signal; the low-pass filter circuit 560 that demodulates the amplified modulated signal Msa is an example of a third demodulation circuit; and the coil L1 included in the low-pass filter circuit 560 is an example of a third coil.

The structures of the driving signal creation circuits 310*a*-1 to 310*a*-4 and 310*b* are not limited to class-D amplification circuits described above. That is, the driving signal creation circuits 310*a*-1 to 310*a*-4 and 310*b* only need to have a structure that can amplify the waveform of the base driving signal aA. The driving signal creation circuits 310*a*-1 to 310*a*-4 and 310*b* may be formed from, for example, class-A amplification circuits, class-B amplification circuits, class-AB amplification circuits, or the like.

6 Structure of the Driving Circuit Board

On the driving circuit board 30, the driving signal creation circuit 310*a*-1 creates the driving signal COM-A1 to be supplied to a plurality of piezoelectric elements 60 included in the discharging module 400-1. Similarly, the driving signal creation circuit 310*a*-2 creates the driving signal COM-A2 to be supplied to a plurality of piezoelectric elements 60 included in the discharging module 400-2, and the driving signal creation circuit 310*b* creates the driving signal COM-B to be supplies to a plurality of piezoelectric elements 60 included in both the discharging modules 400-1 and 400-2. In other words, the piezoelectric elements 60 included in the discharging module 400-1 cause liquids to be discharged from the nozzles 651 corresponding to the piezoelectric elements 60 by being driven according to the driving signal COM-A1 created by the driving signal creation circuit 310*a*-1 and to the driving signal COM-B created by the driving signal creation circuit 310*b*. Similarly, the piezoelectric elements 60 included in the discharging module 400-2 cause liquids from the nozzles 651 corresponding to the piezoelectric elements 60 by being driven according to the driving signal COM-A2 created by the driving signal creation circuit 310*a*-2 and to the driving signal COM-B created by the driving signal creation circuit 310*b*.

That is, the driving circuit board 30 includes the driving signal creation circuits 310*a*-1 to 310*a*-4 that respectively supply the driving signals COM-A1 to COM-A4 to the discharging modules 400-1 to 400-4 and also includes the driving signal creation circuit 310*b* that supplies the driving signal COM-B to the discharging modules 400-1 to 400-4 as a common signal.

Figure 15:
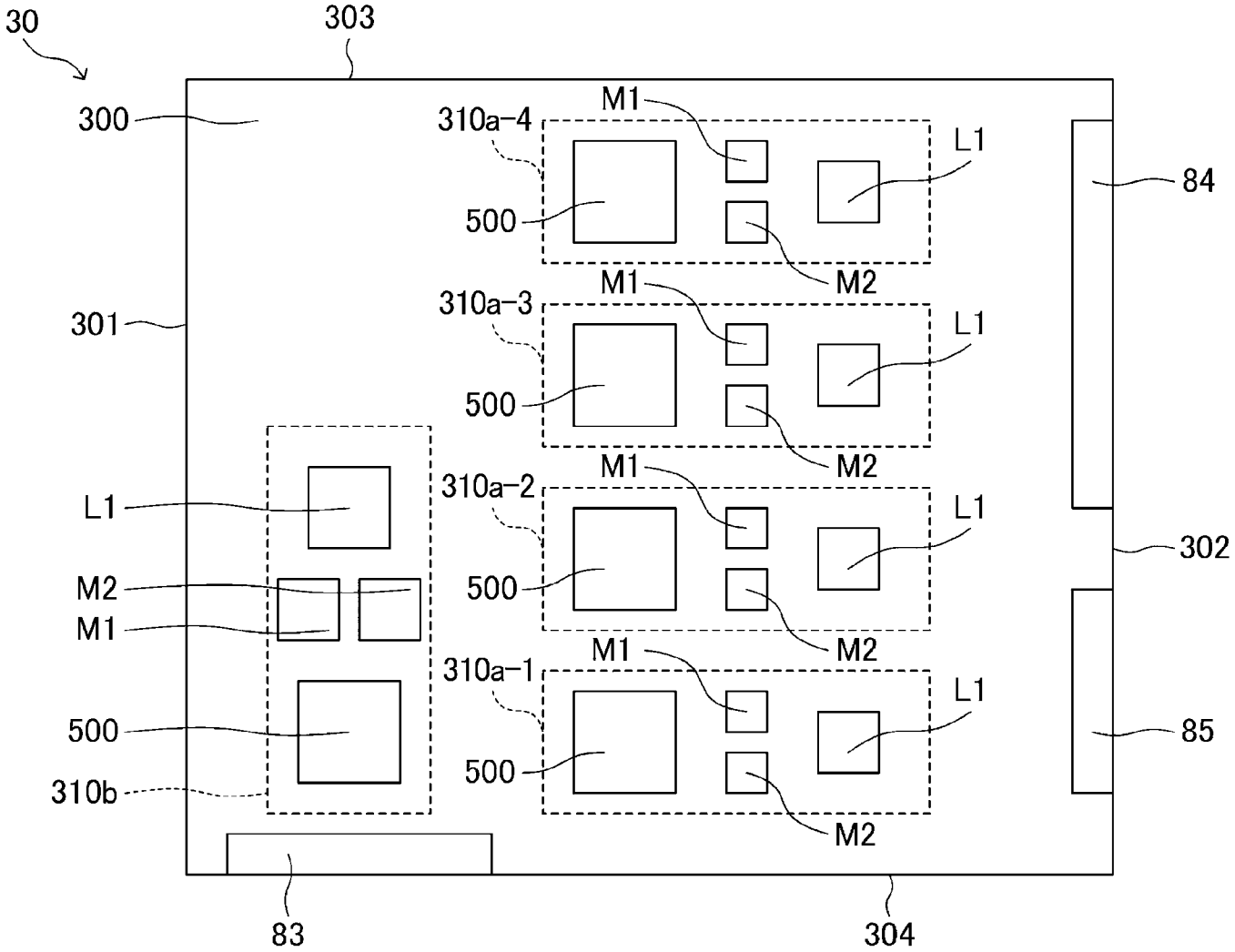
FIG. 15 illustrates the structure of a driving circuit board.

Now, the structure of the driving circuit board 30, on which the driving signal creation circuits 310*a*-1 to 310*a*-4 and 310*b* are provided, will be described. FIG. 15 illustrates the structure of the driving circuit board 30. As illustrated in FIG. 15, the driving circuit board 30 has a circuit board 300, the driving signal creation circuits 310*a*-1 to 310*a*-4 and 310*b*, and the connectors 83, 84 and 85. Although not illustrated in FIG. 15, the voltage conversion circuit 330 illustrated in FIG. 7, wires through which various signals are transferred, and the like are provided on the circuit board 300 besides the components described above.

The circuit board 300 has a substantially rectangular shape having a side 301, a side 302 opposite to the side 301, a side 303, and a side 304 opposite to the side 303. However, the shape of the circuit board 300 is not limited to a rectangle. For example, the shape of the circuit board 300 may be a hexagon, an octagon, or another polygon. Furthermore, the circuit board 300 may partially have a notch, an arc, or the like. That is, the side 301 and side 303 are not parallel to each other. In other words, a virtual straight line that is an extension of the side 301 and a virtual straight line that is an extension of the side 303 cross each other. In this case, in this embodiment, the two virtual straight lines are orthogonal to each other. The side 301 is an example of a first side, the side 302 is an example of a second side, the side 304 is an example of a third side, and the side 303 is an example of a fourth edge.

The connector 83 has a plurality of terminals (not illustrated). The connector 83 is disposed on the same side as the side 304 of the circuit board 300 so that the plurality of terminals are disposed side by side along the side 304. The connector 84 has a plurality of terminals (not illustrated). The connector 84 is disposed on the same side as the side 302 of the circuit board 300 so that the plurality of terminals are disposed side by side along the side 302. The connector 85 has a plurality of terminals (not illustrated). The connector 85 is disposed on the same side as the side 302 of the circuit board 300 so that the plurality of terminals are disposed side by side along the side 302. In this case, the connector 84 is positioned next to a side of the connector 85, the side being on the same side as the side 303. The connector 84 is an example of an example of an output connector that outputs the driving signals COM-A1 to COM-A4 and COM-B to the liquid discharging head 40.

On the circuit board 300, the driving signal creation circuits 310*a*-1 to 310*a*-4 and 310*b* are positioned so that the shortest distance between the side 301 and the driving signal creation circuit 310*a*-1 is longer than the shortest distance between the side 301 and the driving signal creation circuit 310*b*, the shortest distance between the side 301 and the driving signal creation circuit 310*a*-2 is longer than the shortest distance between the side 301 and the driving signal creation circuit 310*b*, the shortest distance between the side 301 and the driving signal creation circuit 310*a*-3 is longer than the shortest distance between the side 301 and the driving signal creation circuit 310*b*, and the shortest distance between the side 301 and the driving signal creation circuit 310*a*-4 is longer than the shortest distance between the side 301 and the driving signal creation circuit 310*b*.

Specifically, on the circuit board 300, the integrated circuit device 500 and a set of the transistors M1 and M2 that are all included in the driving signal creation circuit 310*a*-1 are positioned side by side in a direction away from the side 301 and toward the side 302. To be more specific, the transistors M1 and M2 are positioned side by side in a direction away from the side 303 and toward the side 304. The integrated circuit device 500 and the set of the transistors M1 and M2 are positioned side by side in that order in the direction away from the side 301 and toward the side 302.

On the circuit board 300, the driving signal creation circuit 310*a*-2 is positioned next to a side of the driving signal creation circuit 310*a*-1, the side being on the same side as the side 303. In addition, on the circuit board 300, the integrated circuit device 500 and a set of the transistors M1 and M2 that are all included in the driving signal creation circuit 310*a*-2 are positioned side by side in the direction away from the side 301 and toward the side 302. To be more specific, the transistors M1 and M2 are positioned side by side in the direction away from the side 303 and toward the side 304. The integrated circuit device 500 and the set of the combination of the transistors M1 and M2 are positioned side by side in that order in the direction away from the side 301 and toward the side 302.

On the circuit board 300, the driving signal creation circuit 310*a*-3 is positioned next to a side of the driving signal creation circuit 310*a*-2, the side being on the same side as the side 303. In addition, on the circuit board 300, the integrated circuit device 500 and a set of the transistors M1 and M2 that are all included in the driving signal creation circuit 310*a*-3 are positioned side by side in the direction away from the side 301 and toward the side 302. To be more specific, the transistors M1 and M2 are positioned side by side in the direction away from the side 303 and toward the side 304. The integrated circuit device 500 and the set of the transistors M1 and M2 are positioned side by side in that order in the direction away from the side 301 and toward the side 302.

On the circuit board 300, the driving signal creation circuit 310*a*-4 is positioned next to a side of the driving signal creation circuit 310*a*-3, the side being on the same side as the side 303. In addition, on the circuit board 300, the integrated circuit device 500 and a set of the transistors M1 and M2 that are all included in the driving signal creation circuit 310*a*-4 are positioned side by side in the direction away from the side 301 and toward the side 302. To be more specific, the transistors M1 and M2 are positioned side by side in the direction away from the side 303 and toward the side 304. The integrated circuit device 500 and the set of the transistors M1 and M2 are positioned side by side in that order in the direction away from the side 301 and toward the side 302.

On the circuit board 300, the driving signal creation circuit 310*b* is positioned next to sides of the driving signal creation circuit 310*a*-1 to driving signal creation circuit 310*a*-4, the sides being on the same side as the side 301. In addition, on the circuit board 300, the integrated circuit device 500 and a set of the transistors M1 and M2 that are all included in the driving signal creation circuit 310*b* are positioned side by side in a direction away from the side 304 and toward the side 303. To be more specific, the transistors M1 and M2 are positioned side by side in the direction away from the side 301 and toward the side 302. The integrated circuit device 500 and the set of the transistors M1 and M2 are positioned side by side in that order in the direction away from the side 304 and toward the side 303.

As illustrated in FIG. 15, the transistors M1 and M2 included in the driving signal creation circuit 310*b* may be larger in size than the transistors M1 and M2 included in the driving signal creation circuit 310*a*-1, the transistors M1 and M2 included in the driving signal creation circuit 310*a*-2, the transistors M1 and M2 included in the driving signal creation circuit 310*a*-3, and the transistors M1 and M2 included in the driving signal creation circuit 310*a*-4.

The maximum value of a current that can be supplied to the transistors M1 and M2 included in the driving signal creation circuit 310*b* may be larger than the maximum value of a current that can be supplied to the transistors M1 and M2 included in the driving signal creation circuit 310*a*-1, the maximum value of a current that can be supplied to the transistors M1 and M2 included in the driving signal creation circuit 310*a*-2, the maximum value of a current that can be supplied to the transistors M1 and M2 included in the driving signal creation circuit 310*a*-3, and the maximum value of a current that can be supplied to the transistors M1 and M2 included in the driving signal creation circuit 310*a*-4.

As described above, the driving signal creation circuits 310*a*-1 to 310*a*-4 respectively create the driving signals COM-A1 to COM-A4 and respectively supply them to the discharging modules 400-1 to 400-4. By contrast, the driving signal creation circuit 310*b* creates the driving signal COM-B common to the discharging modules 400-1 to 400-4 and supplies the driving signal COM-B to them. Therefore, the amount of current attributable to the output of the driving signal COM-B from the driving signal creation circuit 310*b* is larger than the amount of current attributable to the output of the driving signal COM-A1 from the driving signal creation circuit 310*a*-1, the amount of current attributable to the output of the driving signal COM-A2 from the driving signal creation circuit 310*a*-2, the amount of current attributable to the output of the driving signal COM-A3 from the driving signal creation circuit 310*a*-3, and the amount of current attributable to the output of the driving signal COM-A4 from the driving signal creation circuit 310*a*-4.

Therefore, it becomes possible to reduce heat generated in the driving signal creation circuit 310*b* by making the transistors M1 and M2 included in the driving signal creation circuit 310*b* larger in size than the transistors M1 and M2 included in each of the driving signal creation circuits 310*a*-1 to 310*a*-4 or making the maximum amount of current that can be supplied to the transistors M1 and M2 included in the driving signal creation circuit 310*b* greater than the maximum amount of current that can be supplied to the transistors M1 and M2 included in each of the driving signal creation circuits 310*a*-1 to 310*a*-4.

The coil L1 included in the driving signal creation circuit 310*b* may be larger in size than the coil L1 included in the driving signal creation circuit 310*a*-1, the coil L1 included in the driving signal creation circuit 310*a*-2, the coil L1 included in the driving signal creation circuit 310*a*-3, and the coil L1 included in the driving signal creation circuit 310*a*-4.

As described above, the amount of current attributable to the output of the driving signal COM-B from the driving signal creation circuit 310*b* is larger than the amount of current attributable to the output of the driving signal COM-A1 from the driving signal creation circuit 310*a*-1, the amount of current attributable to the output of the driving signal COM-A2 from the driving signal creation circuit 310*a*-2, the amount of current attributable to the output of the driving signal COM-A3 from the driving signal creation circuit 310*a*-3, and the amount of current attributable to the output of the driving signal COM-A4 from the driving signal creation circuit 310*a*-4.

When the coil L1 included in the driving signal creation circuit 310*b* is made larger in size than the coil L1 included in each of the driving signal creation circuits 310*a*-1 to 310*a*-4, it becomes possible to increase the number of windings of the coil L1 in the driving signal creation circuit 310*b* and to increase the effective sectional area of the core on which the winding wire is wound. Thus, it becomes possible to reduce the density of the magnetic flux generated around the coil L1 included in the driving signal creation circuit 310*b*. Therefore, even when the coil L1 is included in the driving signal creation circuit 310*b*, in which a large current flows, it becomes possible to reduce the risk that the magnetic flux generated around the coil L1 reaches the saturation flux density.

As illustrated in FIG. 15, the connector 84 is disposed along the side 302 on the circuit board 300, the side 302 being closer to the driving signal creation circuits 310*a*-1 to 310*a*-4 than to the driving signal creation circuit 310*b*. Specifically, the shortest distance between the driving signal creation circuit 310*a*-1 and the connector 84 is shorter than the shortest distance between the driving signal creation circuit 310*b* and the connector 84, the shortest distance between the driving signal creation circuit 310*a*-2 and the connector 84 is shorter than the shortest distance between the driving signal creation circuit 310*b* and the connector 84, the shortest distance between the driving signal creation circuit 310*a*-3 and the connector 84 is shorter than the shortest distance between the driving signal creation circuit 310*b* and the connector 84, and the shortest distance between the driving signal creation circuit 310*a*-4 and the connector 84 is shorter than the shortest distance between the driving signal creation circuit 310*b* and the connector 84. Thus, on the circuit board 300, it becomes possible to reduce the lengths of wires through which the driving signals COM-A1 to COM-A4 are transferred, reducing the risk that the waveforms of the driving signals COM-A1 to COM-A4, which are respectively supplied to the discharging modules 400-1 to 400-4, are warped. This can reduce the risk that precision with which an ink is discharged varies among the discharging modules 400-1 to 400-4.

Figure 16:
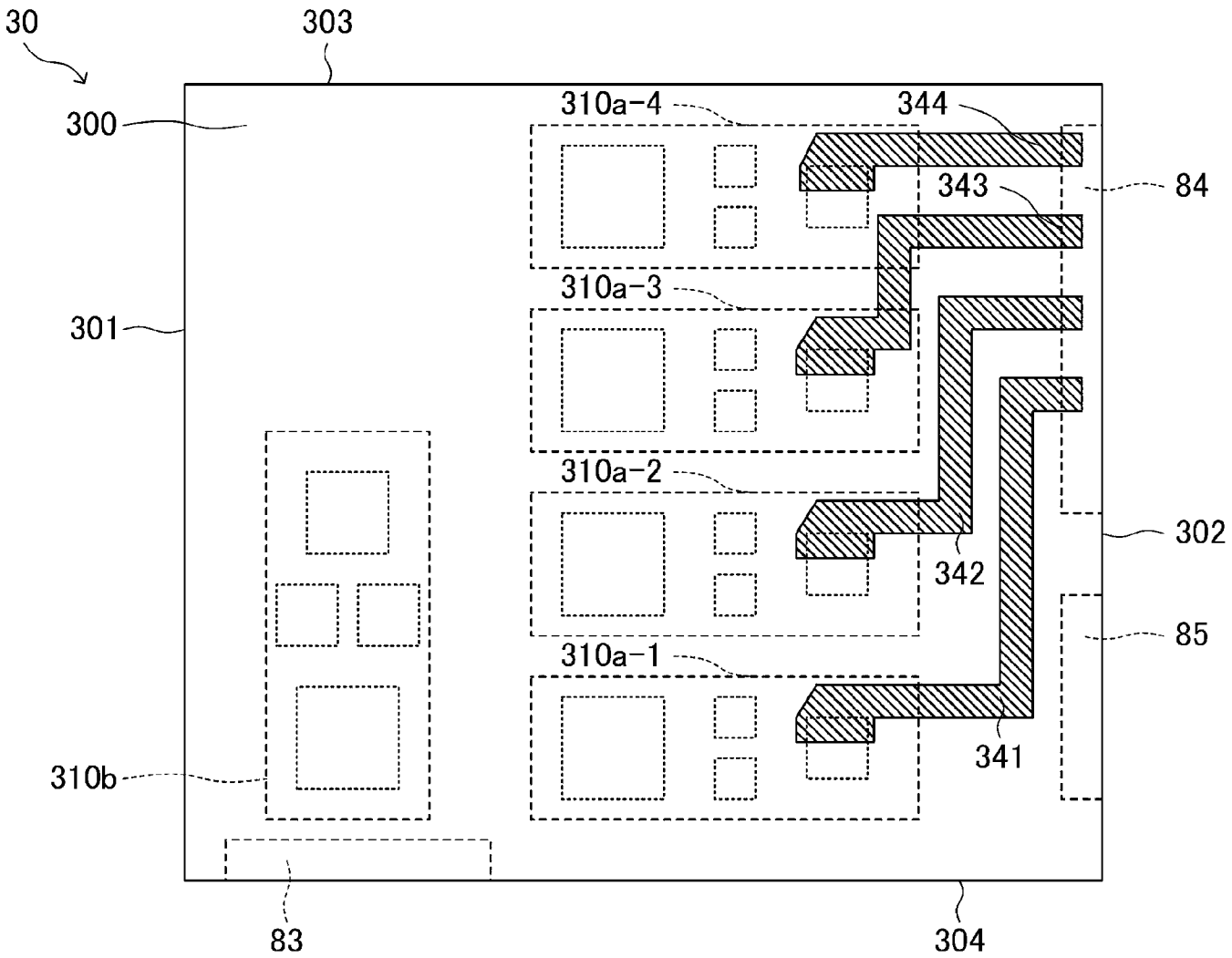
FIG. 16 illustrates an example of wires through which driving signals COM-A1 to COM-A4 are transferred.
Figure 17:
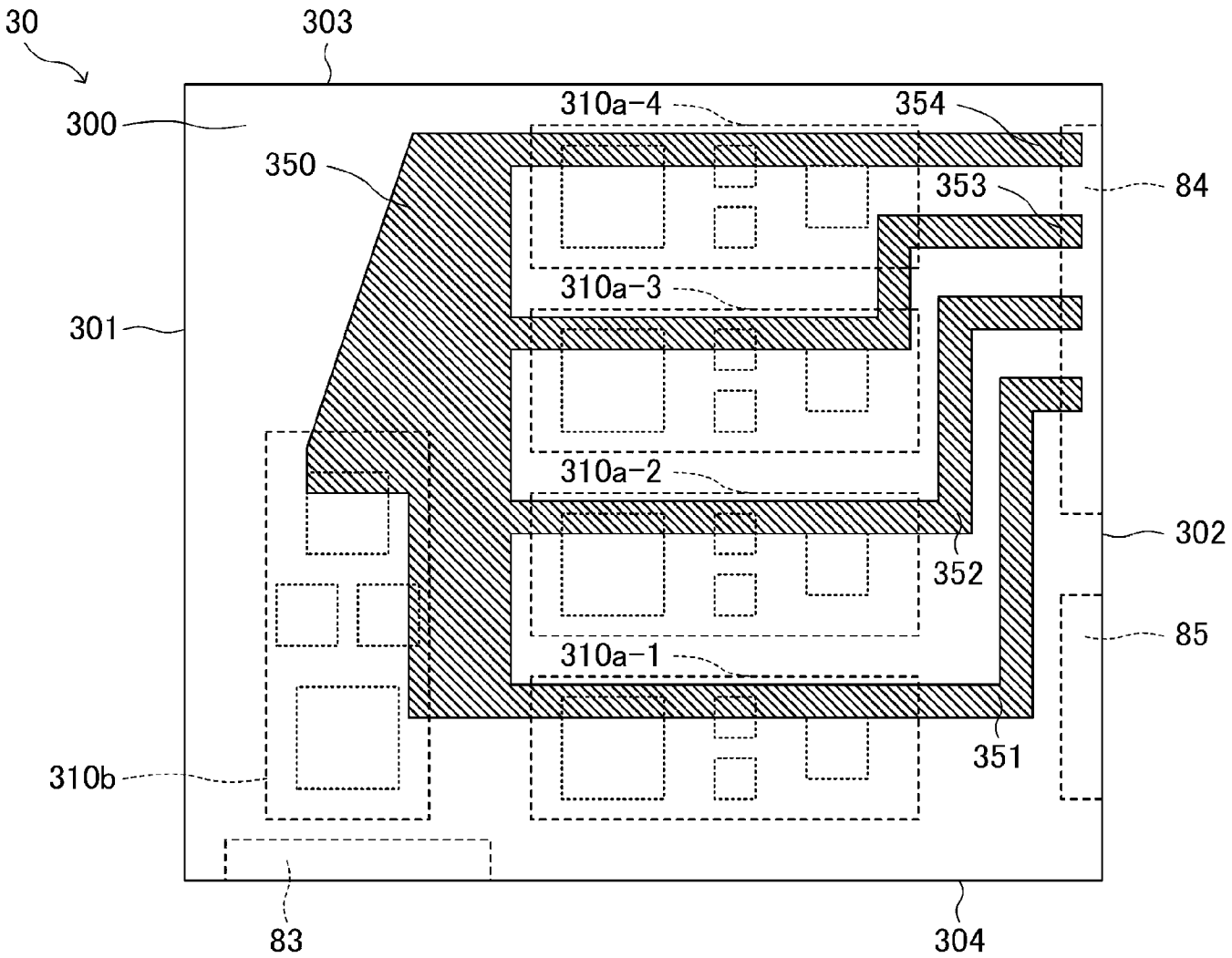
FIG. 17 illustrates an example of wires through which a driving signal COM-B is transferred.

Now, wires through which the driving signals COM-A1 to COM-A4 and COM-B are transferred will be described with reference to FIGS. 16 and 17. FIG. 16 illustrates an example of wires through which the driving signals COM-A1 to COM-A4 are transferred. FIG. 17 illustrates an example of wires through which the driving signal COM-B is transferred. In this embodiment, on the circuit board 300, the wires through which the driving signals COM-A1 to COM-A4 are transferred are disposed in a wiring layer different from a wiring layer in which the integrated circuit device 500 described above is mounted. On the circuit board 300, the wires through which the driving signal COM-B is transferred are disposed in a wiring layer different from the wiring layer in which the integrated circuit device 500 described above is mounted and from the wiring layer in which the wires through which the driving signals COM-A1 to COM-A4 are transferred are disposed. In FIGS. 16 and 17, areas in which the driving signal creation circuits 310*a*-1 to 310*a*-4 and 310-*b*, which are disposed in different wiring layers, are mounted are indicated by dashed lines.

As illustrated in FIG. 16, the driving signal creation circuit 310*a*-1 and connector 84 are electrically coupled to each other through a wire 341. Therefore, the driving signal COM-A1 is transferred through the wire 341, after which the driving signal COM-A1 is supplied to the liquid discharging head 40 through the connector 84. The driving signal creation circuit 310*a*-2 and connector 84 are electrically coupled to each other through a wire 342. Therefore, the driving signal COM-A2 is transferred through the wire 342, after which the driving signal COM-A2 is supplied to the liquid discharging head 40 through the connector 84. The driving signal creation circuit 310*a*-3 and connector 84 are electrically coupled to each other through a wire 343. Therefore, the driving signal COM-A3 is transferred through the wire 343, after which the driving signal COM-A3 is supplied to the liquid discharging head 40 through the connector 84. The driving signal creation circuit 310*a*-4 and connector 84 are electrically coupled to each other through a wire 344. Therefore, the driving signal COM-A4 is transferred through the wire 344, after which the driving signal COM-A4 is supplied to the liquid discharging head 40 through the connector 84.

As illustrated in FIG. 17, the driving signal creation circuit 310*b* and connector 84 are electrically coupled to each other through a wire 350 and branch lines 351 to 354 branching from the wire 350. Specifically, the driving signal creation circuit 310*b* is electrically coupled to the wire 350. On the circuit board 300, the wire 350 branches into the branch lines 351 to 354. The branch wire 351 carries the driving signal COM-B to be supplied to the discharging module 400-1. The branch wire 352 carries the driving signal COM-B to be supplied to the discharging module 400-2. The branch wire 353 carries the driving signal COM-B to be supplied to the discharging module 400-3. The branch wire 354 carries the driving signal COM-B to be supplied to the discharging module 400-4.

Each of the branch wires 351 to 354 carries the driving signal COM-B to be supplied to the piezoelectric element 60 disposed in a different discharging module 400. Therefore, when signals transferred through the branch wires 351 to 354 cause interference, the waveform of the driving signal COM-B to be supplied to the piezoelectric element 60 is distorted. When the driving signal COM-B is transferred through each of the branch wires 351 to 354, it becomes possible to reduce the risk that signals transferred through the branch wires 351 to 354 cause mutual interference.

The area of the wire 350 through which the driving signal COM-B is transferred may be larger than the area of each of the branch wires 351 to 354. The current that will flow in the branch wires 351 to 354 concentrates in the wire 350. When the area of the wire 350 is larger than the area of each of the branch wires 351 to 354, it becomes possible to reduce the impedance of the wire 350 and thereby to reduce the risk that waveform distortion is caused in the driving signal COM-B by the impedance component. The wire 350 is an example of a first wire, the branch wire 351 is an example of a second wire, the branch wire 352 is an example of a third wire, the branch wire 353 is another example of the third wire, and the branch wire 354 is another example of the third wire.

The branch wires 351 to 354, through which the driving signal COM-B is transferred, may branch from the wire 350 at points closer to the driving signal creation circuit 310*b* than to the connector 84. Specifically, the shortest distance between the driving signal creation circuit 310*b* and the branch point between the wire 350 and the branch wire 351 may be shorter than the shortest distance between the connector 84 and the branch point between the wire 350 and the branch wire 351, the shortest distance between the driving signal creation circuit 310*b* and the branch point between the wire 350 and the branch wire 352 may be shorter than the shortest distance between the connector 84 and the branch point between the wire 350 and the branch wire 352, the shortest distance between the driving signal creation circuit 310*b* and the branch point between the wire 350 and the branch wire 353 may be shorter than the shortest distance between the connector 84 and the branch point between the wire 350 and the branch wire 353, and the shortest distance between the driving signal creation circuit 310*b* and the branch point between the wire 350 and the branch wire 354 may be shorter than the shortest distance between the connector 84 and the branch point between the wire 350 and the branch wire 354.

Thus, it becomes possible to further reduce the risk that signals transferred through the branch wires 351 to 354 cause mutual interference.

7 Effects

The liquid discharging apparatus 1 in this embodiment described above has, on the circuit board 300, the driving signal creation circuit 310*a*-1 that creates the driving signal COM-A1, the driving signal creation circuit 310*a*-2 that creates the driving signal COM-A2, the driving signal creation circuit 310*a*-3 that creates the driving signal COM-A3, the driving signal creation circuit 310*a*-4 that creates the driving signal COM-A4, and the driving signal creation circuit 310*b* that creates the driving signal COM-B. The driving signal COM-A1 and driving signal COM-B are supplied to the piezoelectric elements 60 included in the discharging module 400-1. The driving signal COM-A2 and driving signal COM-B are supplied to the piezoelectric elements 60 included in the discharging module 400-2. The driving signal COM-A3 and driving signal COM-B are supplied to the piezoelectric elements 60 included in the discharging module 400-3. The driving signal COM-A4 and driving signal COM-B are supplied to the piezoelectric elements 60 included in the discharging module 400-4. That is, the driving signal COM-B is supplied, as a common signal, to the piezoelectric elements 60 included in each of the discharging modules 400-1 to 400-4. Therefore, even when the number of discharging modules 400, each of which has nozzle rows, is increased on the driving circuit board 30, the risk can be reduced that the number of driving signal creation circuits 310*b* that create the driving signal COM-B is increased. This makes it possible to reduce the risk that the circuit size of the liquid discharging apparatus 1 is increased.

In the liquid discharging apparatus 1 in this embodiment, the driving signal creation circuits 310*a*-1 to 310*a*-4 and 310*b* are provided on the circuit board 300 so that the shortest distance between the side 301 and the driving signal creation circuit 310*a*-1 is longer than the shortest distance between the side 301 and the driving signal creation circuit 310*b*, the shortest distance between the side 301 and the driving signal creation circuit 310*a*-2 is longer than the shortest distance between the side 301 and the driving signal creation circuit 310*b*, the shortest distance between the side 301 and the driving signal creation circuit 310*a*-3 is longer than the shortest distance between the side 301 and the driving signal creation circuit 310*b*, and the shortest distance between the side 301 and the driving signal creation circuit 310*a*-4 is longer than the shortest distance between the side 301 and the driving signal creation circuit 310*b*. That is, the driving signal creation circuits 310*a*-1 to 310*a*-4 are disposed on the same side as the side 302 opposite to the side 301 of the circuit board 300, and the driving signal creation circuit 310*b* is disposed on the same side as the side 301 of the circuit board 300. The integrated circuit devices 500 and a set of the transistors M1 and M2 that are all included in each of the driving signal creation circuits 310*a*-1 to 310*a*-4 are positioned side by side in the direction away from the side 301 and toward the side 302. The integrated circuit devices 500 and a set of the transistors M1 and M2 that are all included in the driving signal creation circuit 310*b* are positioned side by side in the direction away from the side 304 and toward the side 303. That is, the driving signal creation circuit 310*b* is disposed so that its orientation is rotated with respect to the driving signal creation circuits 310*a*-1 to 310*a*-4. Thus, it becomes possible to reduce the risk that dead space, in which circuit elements, wiring patterns, or the like are not disposed on the circuit board 300, is formed when compared with a case in which the driving signal creation circuit 310*b* is oriented in the same direction as the driving signal creation circuits 310*a*-1 to 310*a*-4. This makes it possible to reduce the risk that the circuit size of the liquid discharging apparatus 1 is increased.

8 Variations

In the liquid discharging apparatus 1 described above, on the driving circuit board 30, the transistors M1 and M2 included in the driving signal creation circuit 310*b* may have the same size as the transistors M1 and M2 included in at least any one of the driving signal creation circuits 310*a*-1 to 310*a*-4, and the maximum value of a current that can be supplied to the transistors M1 and M2 included in the driving signal creation circuit 310*b* may be equal to the maximum value of a current that can be supplied to transistors M1 and M2 included in at least any one of the driving signal creation circuits 310*a*-1 to 310*a*-4. The coil L1 included in the driving signal creation circuit 310*b* may have the same size as the coil L1 included in at least any of the driving signal creation circuits 310*a*-1 to 310*a*-4.

Figure 18:
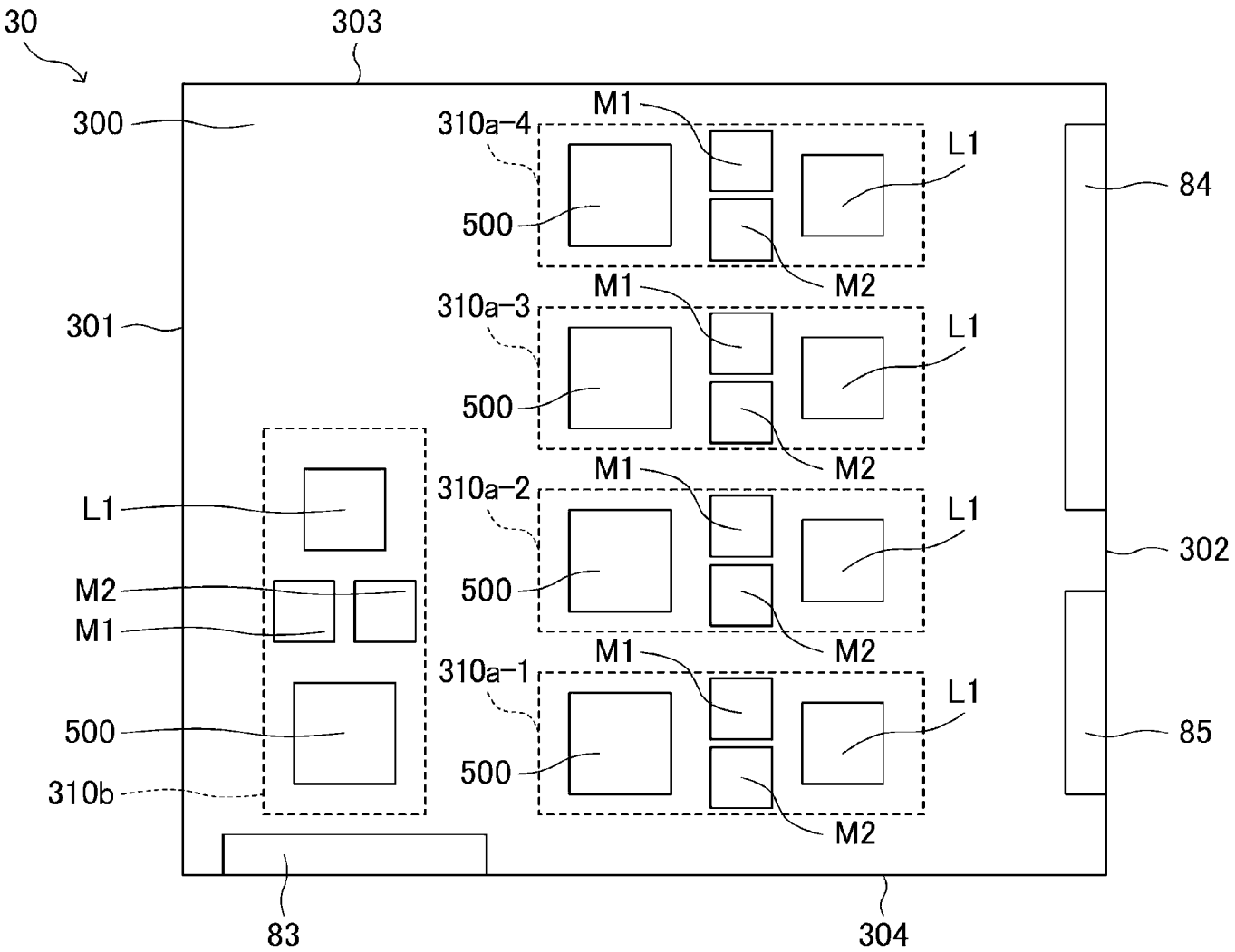
FIG. 18 illustrates an example of a variation of the structure of the driving circuit board.

FIG. 18 illustrates an example of a variation of the structure of the driving circuit board 30. Specifically, on the driving circuit board 30 in the liquid discharging apparatus 1, at least any one of the transistors M1 and M2 included in the driving signal creation circuit 310*a*-1, the transistors M1 and M2 included in the driving signal creation circuit 310*a*-2, the transistors M1 and M2 included in the driving signal creation circuit 310*a*-3, and the transistors M1 and M2 included in the driving signal creation circuit 310*a*-4 may have the same size as the transistors M1 and M2 included in the driving signal creation circuits 310*b*, as illustrated in FIG. 18.

Furthermore, at least any one of the maximum value of a current that can be supplied to the transistors M1 and M2 included in the driving signal creation circuit 310*a*-1, the maximum value of a current that can be supplied to the transistors M1 and M2 included in the driving signal creation circuit 310*a*-2, the maximum value of a current that can be supplied to the transistors M1 and M2 included in the driving signal creation circuit 310*a*-3, and the maximum value of a current that can be supplied to the transistors M1 and M2 included in the driving signal creation circuit 310*a*-4 may be equal to the maximum value of a current that can be supplied to the transistors M1 and M2 included in the driving signal creation circuit 310*b*.

As described above, the amount of current attributable to the output of the driving signal COM-B from the driving signal creation circuit 310*b* is larger than the amount of current attributable to the output of the driving signal COM-A1 from the driving signal creation circuit 310*a*-1, the amount of current attributable to the output of the driving signal COM-A2 from the driving signal creation circuit 310*a*-2, the amount of current attributable to the output of the driving signal COM-A3 from the driving signal creation circuit 310*a*-3, and the amount of current attributable to the output of the driving signal COM-A4 from the driving signal creation circuit 310*a*-4. That is, when the transistors M1 and M2 included in each of the driving signal creation circuits 310*a*-1 to 310*a*-4 have the same size as the transistors M1 and M2 included in the driving signal creation circuits 310*b* or the maximum value of a current that can be supplied to each of the transistors M1 and M2 included in the driving signal creation circuits 310*a*-1 to 310*a*-4 is equal to the maximum value of a current that can be supplied to the transistors M1 and M2 included in the driving signal creation circuit 310*b*, it becomes possible to reduce a temperature rise in the transistors M1 and M2 in each of the driving signal creation circuits 310*a*-1 to 310*a*-4. Therefore, changes are reduced in properties of the transistors M1 and M2 included in each of the driving signal creation circuits

310*a*-1 to 310*a*-4, the changes being caused due to a temperature rise in the transistors M1 and M2. This enables the driving signal creation circuits 310*a*-1 to 310*a*-4 to create the driving signals COM-A and COM-B.

On the driving circuit board 30 in the liquid discharging apparatus 1, at least any one of the coil L1 included in the driving signal creation circuit 310*a*-1, the coil L1 included in the driving signal creation circuit 310*a*-2, the coil L1 included in the driving signal creation circuit 310*a*-3, and the coil L1 included in the driving signal creation circuit 310*a*-4 may have the same size as the coil L1 included in the driving signal creation circuits 310*b*, as illustrated in FIG. 18.

When the coil L1 included in each of the driving signal creation circuits 310*a*-1 to 310*a*-4 has the same size as the coil L1 included in the driving signal creation circuit 310*b*, it becomes possible to increase the diameter of the winding wire of the coil L1 in each of the driving signal creation circuits 310*a*-1 to 310*a*-4. This makes it possible to reduce heat generated in the coil L1 and to reduce changes in properties of the coil L1, the changes being caused due to a temperature rise in the coil L1. Therefore, each of driving signal creation circuits 310*a*-1 to 310*a*-4 can create the driving signals COM-A and COM-B having a more stable waveform.

So far, an embodiment and variations have been described. However, the present disclosure is not limited to the embodiment and variations. The present disclosure can be modified in various aspects without departing from the intended scope of the present disclosure. For example, the above embodiment and variations can be appropriately combined.

The present disclosure includes substantially the same structure as a structure described in this embodiment, the same structure being, for example, a structure having the same function, method and result or the same object and effects as described in this embodiment. The present disclosure also includes a structure in which a portion that is not essential to a structure described in the embodiment is replaced. The present disclosure also includes a structure that has the same effects as the effects of a structure described in this embodiment or a structure that can achieve the same object as the object of a structure described in this embodiment. The present disclosure also includes a structure in which a known technology is added to a structure described in this embodiment.

What is claimed is:

1. A liquid discharging apparatus comprising:

a first driving signal creation circuit that creates a first driving signal;

a second driving signal creation circuit that creates a second driving signal;

a third driving signal creation circuit that creates a third driving signal;

a liquid discharging head having a first piezoelectric element and a second piezoelectric element; and a circuit board having a first side, a second side opposite to the first side, a third side, and a fourth side opposite to the third side, the circuit board including the first driving signal creation circuit, the second driving signal creation circuit, and the third driving signal creation circuit; wherein when the first piezoelectric element is driven in response to the first driving signal and the third driving signal, the first piezoelectric element causes liquid to be discharged from a first nozzle, when the second piezoelectric element is driven in response to the second driving signal and the third driving signal, the second piezoelectric element causes liquid to be discharged from a second nozzle, the first driving signal creation circuit has a first transistor that amplifies a signal based on a first base driving signal from which the first driving signal is created, and also has a first integrated circuit that controls operation of the first transistor, the second driving signal creation circuit has a second transistor that amplifies a signal based on a second base driving signal from which the second driving signal is created, and also has a second integrated circuit that controls operation of the second transistor, the third driving signal creation circuit has a third transistor that amplifies a signal based on a third base driving signal from which the third driving signal is created, and also has a third integrated circuit that controls operation of the third transistor, the shortest distance between the first side and the first driving signal creation circuit is longer than the shortest distance between the first side and the third driving signal creation circuit, the shortest distance between the first side and the second driving signal creation circuit is longer than the shortest distance between the first side and the third driving signal creation circuit, the first integrated circuit and the first transistor are positioned on the circuit board side by side in a direction away from the first side and toward the second side, the second integrated circuit and the second transistor are positioned on the circuit board side by side in the direction away from the first side and toward the second side, and the third integrated circuit and the third transistor are positioned on the circuit board side by side in a direction away from the third side and toward the fourth side.

2. The liquid discharging apparatus according to claim 1, wherein:

the circuit board includes an output connector that outputs the first driving signal, the second driving signal, and the third driving signal to the liquid discharging head;

the shortest distance between the first driving signal creation circuit and the output connector is shorter than the shortest distance between the third driving signal creation circuit and the output connector; and the shortest distance between the second driving signal creation circuit and the output connector is shorter than the shortest distance between the third driving signal creation circuit and the output connector.

3. The liquid discharging apparatus according to claim 1, wherein:

the circuit board has a first wire, a second wire, and a third wire;

the first wire is electrically coupled to the third driving signal creation circuit;

the second wire branches from the first wire and carries the third driving signal to the first piezoelectric element; and the third wire branches from the first wire and carries the third driving signal to the second piezoelectric element.

4. The liquid discharging apparatus according to claim 1, wherein the third transistor is larger in size than the first the transistor and is larger in size than the second the transistor.

5. The liquid discharging apparatus according to claim 1, wherein the third transistor has the same size as at least any one of the first transistor and the second the transistor.

6. The liquid discharging apparatus according to claim 1, wherein the maximum value of current that is capable of being supplied to the third transistor is larger than the maximum value of current that can be supplied to the first transistor and is larger than the maximum value of current that is capable of being supplied to the second transistor.

7. The liquid discharging apparatus according to claim 1, wherein the maximum value of current that is capable of being supplied to the third transistor is equal to at least any one of the maximum value of current that is capable of being to the first transistor and the maximum value of current is capable of being supplied to the second transistor.

8. The liquid discharging apparatus according to claim 1, wherein:

the first driving signal creation circuit has a first modulation circuit and a first demodulation circuit;

the second driving signal creation circuit has a second modulation circuit and a second demodulation circuit;

the third driving signal creation circuit has a third modulation circuit and a third demodulation circuit;

the first demodulation circuit is included in the first integrated circuit and demodulates the first base driving signal to create a first modulated signal;

the first transistor amplifies the first modulated signal to create a first amplified modulated signal;

the first demodulation circuit includes a first coil and demodulates the first amplified modulated signal according to the first coil to create the first driving signal;

the second demodulation circuit is included in the second integrated circuit and demodulates the second base driving signal to create a second modulated signal;

the second transistor amplifies the second modulated signal to create a second amplified modulated signal;

the second demodulation circuit includes a second coil and demodulates the second amplified modulated signal according to the second coil to create the second driving signal;

the third demodulation circuit is included in the third integrated circuit and demodulates the third base driving signal to create a third modulated signal;

the third transistor amplifies the third modulated signal to create a third amplified modulated signal;

the third demodulation circuit includes a third coil and demodulates the third amplified modulated signal according to the third coil to create the third driving signal; and the third coil is larger in size than the first coil and is larger in size than the second coil.

9. The liquid discharging apparatus according to claim 1, wherein:

the first driving signal creation circuit has a first modulation circuit and a first demodulation circuit;

the second driving signal creation circuit has a second modulation circuit and a second demodulation circuit;

the third driving signal creation circuit has a third modulation circuit and a third demodulation circuit;

the first demodulation circuit is included in the first integrated circuit and demodulates the first base driving signal to create a first modulated signal;

the first transistor amplifies the first modulated signal to create a first amplified modulated signal;

the first demodulation circuit includes a first coil and demodulates the first amplified modulated signal according to the first coil to create the first driving signal;

the second demodulation circuit is included in the second integrated circuit and demodulates the second base driving signal to create a second modulated signal;

the second transistor amplifies the second modulated signal to create a second amplified modulated signal;

the second demodulation circuit includes a second coil and demodulates the second amplified modulated signal according to the second coil to create the second driving signal;

the third demodulation circuit is included in the third integrated circuit and demodulates the third base driving signal to create a third modulated signal;

the third transistor amplifies the third modulated signal to create a third amplified modulated signal;

the third demodulation circuit includes a third coil and demodulates the third amplified modulated signal according to the third coil to create the third driving signal; and the third coil has the same size as at least any one of the first coil and the second coil.

10. A driving circuit board that has a driving circuit that drives a liquid discharging head having a first piezoelectric element that causes liquid to be discharged from a first nozzle by being driven and also having a second piezoelectric element that causes liquid to be discharged from a second nozzle by being driven, the driving circuit board comprising:

a first driving signal creation circuit that creates a first driving signal;

a second driving signal creation circuit that creates a second driving signal;

a third driving signal creation circuit that creates a third driving signal; and a circuit board having a first side, a second side opposite to the first side, a third side, and a fourth side opposite to the third side, the circuit board including the first driving signal creation circuit, the second driving signal creation circuit, and the third driving signal creation circuit; wherein the first driving signal drives the first piezoelectric element, the second driving signal drives the second piezoelectric element, the third driving signal drives the first piezoelectric element and the second piezoelectric element, the first driving signal creation circuit has a first transistor that amplifies a signal based on a first base driving signal from which the first driving signal is created, and also has a first integrated circuit that controls operation of the first transistor, the second driving signal creation circuit has a second transistor that amplifies a signal based on a second base driving signal from which the second driving signal is created, and also has a second integrated circuit that controls operation of the second transistor, the third driving signal creation circuit has a third transistor that amplifies a signal based on a third base driving signal from which the third driving signal is created, and also has a third integrated circuit that controls operation of the third transistor, the shortest distance between the first side and the first driving signal creation circuit is longer than the shortest distance between the first side and the third driving signal creation circuit, the shortest distance between the first side and the second driving signal creation circuit is longer than the shortest distance between the first side and the third driving signal creation circuit, the first integrated circuit and the first transistor are positioned on the circuit board side by side in a direction away from the first side and toward the second side, the second integrated circuit and the second transistor are positioned on the circuit board side by side in the direction away from the first side and toward the second side, and the third integrated circuit and the third transistor are positioned on the circuit board side by side in a direction away from the third side and toward the fourth side.

* * * * *